US005816216A

United States Patent [19]

Egashira et al.

[11] Patent Number: 5,816,216

[45] Date of Patent: Oct. 6, 1998

[54] DECOMPRESSION BRAKE DEVICE OF AUTOMOTIVE INTERNAL COMBUSTION ENGINE

[75] Inventors: Noboru Egashira; Hirokazu Uehara; Seiji Tsuruta; Akira Torii, all of Kanagawa, Japan

[73] Assignee: Unisia Jecs Corporation, Atsugi, Japan

[21] Appl. No.: 893,581

[22] Filed: Jul. 11, 1997

[30] Foreign Application Priority Data

| | | | |
|---|---|---|---|
| Jul. 12, 1996 | [JP] | Japan | 8-182576 |
| Jul. 12, 1996 | [JP] | Japan | 8-182577 |
| Mar. 24, 1997 | [JP] | Japan | 9-069400 |
| Mar. 25, 1997 | [JP] | Japan | 9-070978 |

[51] Int. Cl.[6] ..... F02D 13/04

[52] U.S. Cl. ..... 123/321

[58] Field of Search ..... 123/321, 322, 123/320, 323, 324

[56] References Cited

U.S. PATENT DOCUMENTS

| | | | |
|---|---|---|---|
| 5,485,819 | 1/1996 | Joko et al. | 123/321 |
| 5,586,532 | 12/1996 | Faletti et al. | 123/321 |
| 5,586,533 | 12/1996 | Feucht | 123/321 |
| 5,611,308 | 3/1997 | Hackett | 123/321 |

FOREIGN PATENT DOCUMENTS

| | | | |
|---|---|---|---|
| 4-54907 | 5/1992 | Japan | 123/321 |
| 6-17632 | 1/1994 | Japan | 123/321 |
| 8-144729 | 6/1996 | Japan | 123/321 |
| 8-270424 | 10/1996 | Japan | 123/321 |

*Primary Examiner*—Raymond A. Nelli
*Attorney, Agent, or Firm*—Foley & Lardner

[57] ABSTRACT

A decompression brake device comprises a valve drive mechanism for driving an exhaust valve of an internal combustion engine. The valve drive mechanism has first, second and third conditions, the first condition being a condition wherein the exhaust valve assumes a fully closed rest position during intake, compression and expansion strokes of the engine and a full open position during an exhaust stroke of the engine, the second condition being a condition wherein the exhaust valve assumes the fully closed rest position during the intake stroke of the engine, a slightly open rest position during the compression and expansion strokes of the engine and the full open position during the exhaust stroke of the engine, and the third condition being a condition wherein the exhaust valve assumes the fully closed rest position during the intake stroke of the engine, a largely open rest position during the compression and expansion strokes of the engine and the full open position during the exhaust stroke of the engine. An actuator is used, which has a hydraulically actuated rod which has first, second and third positions to cause the valve drive mechanism to assume the first, second and third conditions respectively. A hydraulic circuit is used for feeding or drawing a pressurized oil to or from the actuator to move the rod to one of the first, second and third positions.

22 Claims, 32 Drawing Sheets

DECOMPRESSION BRAKE DEVICE OF AUTOMOTIVE INTERNAL COMBUSTION ENGINE

BACKGROUND OF THE INVENTION

1. Field of the Invention

The present invention relates in general to engine brake devices incorporated with internal combustion engines of wheeled motor vehicles, and more particularly decompression brake devices of automotive internal combustion engines. More specifically, the present invention is concerned with the decompression brake devices of a type which can control the braking performance thereof in accordance with an engine speed, a vehicle speed or the like.

2. Description of the Prior Art

Some of internal combustion engines for large-sized heavy duty wheeled motor vehicles are equipped with a so-called decompression brake device which retards the vehicle by effectively using the negative work of the engine. In fact, by slightly opening the exhaust valve of the engine during compression and expansion strokes of a corresponding engine cylinder, engine braking is obtained. One of conventional decompression brake devices is described in Japanese Utility Model First Provisional Publication 4-54907.

In order to clarify the task of the present invention, the decompression brake device of the publication will be briefly described with reference to FIG. 32 of the accompanying drawings.

In FIG. 32, the decompression brake device is schematically illustrated, which is mounted on a cylinder head "C" of an associated internal combustion engine.

The decompression brake device comprises generally an exhaust brake valve 1100 which functions to open and close an exhaust brake port 1102 extending from a combustion chamber of the engine, and a valve drive mechanism 1200 which is mounted on the cylinder head "C" to drive the exhaust brake valve 1100. Although not shown in the drawing, ordinary intake and exhaust valves are incorporated with the combustion chamber. An air cylinder unit 1250 is incorporated with the valve drive mechanism 1200 to adjust the position of the exhaust brake valve 1100.

As shown, the valve drive mechanism 1200 comprises a block 1202 mounted on the cylinder head "C". The block 1202 has a bore into which a stem head of the exhaust brake valve 1100 is received. A tappet 1204 is put on the stem head. A valve spring 1206 is disposed about the stem head to bias the exhaust brake valve 1100 in a direction to close the exhaust brake port 1102. The tappet 1204 has a roller 1205 exposed to a horizontally extending elongate bore 1208 formed in the block 1202. An actuator rod 1210 is axially movably received in the elongate bore 1208 in such a manner that a leading portion thereof is engaged with the roller 1205 of the tappet 1204. The leading portion of the actuator rod 1210 is formed with three flat steps 1210*a*, 1210*b* and 1210*c* which are connected through inclined portions, as shown. Thus, upon movement the actuator rod 210 in the bore 208, three positions of the exhaust brake valve 1100 are defined, which are a fully closed position as shown in the drawing, a small open position and a large open position, as will be described in detail hereinafter. The air cylinder unit 1250 comprises a cylinder 1252 connected to the block 1202. Within this cylinder 1252, there are slidably installed first and second pistons 1254 and 1256. The first piston 1254 has a stem 1257 integrated therewith, and the second piston 1256 has a stem 1258 integrated therewith. As shown, the stem 1258 is connected to the actuator rod 1210 to move therewith. The stem 1257 of the first piston 1254 has a leading end contactable with the second piston 1256, as shown. Due to provision of the two pistons 1254 and 1256, there are defined in the cylinder 1252 first and second working chambers 1260 and 1262. A first stopper 1264 defined by the cylinder 1252 is positioned in the second working chamber 1262, and a second stopper 1266 defined by also the cylinder 1152 is positioned behind the second working chamber 1266. A spring 1268 is compressed between the second piston 1256 and the second stopper 1266 to bias the pistons 1254 and 1256 leftward in the drawing. The first and second working chambers 1260 and 1262 are connectable to a common air pump 1270 through first and second electromagnetic valves 1272 and 1274 which are controlled by an electric controller 1276. Thus, by controlling the two valves 1272 and 1274 with the controller 1276, pressurized air fed to the first and second working chambers 1260 and 1262 by the air pump 1270 is controlled thereby to move the pistons 1254 and 1256 and thus move the actuator rod 1210 to a desired position in the elongate bore 1208.

In a normal cruising condition of the associated motor vehicle wherein an accelerator pedal is kept depressed by a driver, the valve drive mechanism 1200 assumes the illustrated condition. That is, the first and second working chambers 1260 and 1262 have no pressurized air supplied thereto. Thus, the pistons 1254 and 1256 are forced to assume their leftmost positions by the force of the spring 1268 causing engagement of the step 1210*a* of the actuator rod 1210 with the roller 1205 of the tappet 1204. Thus, under this condition, the exhaust brake valve 1100 assumes a fully closed position, as shown.

When the driver turns an exhaust brake switch (not shown) ON with his foot separated from the accelerator pedal, the controller 1276 controls the first and second electromagnetic valves 1272 and 1274 in accordance with a vehicle speed. With this, one of the first and second working chambers 1260 and 1262 is supplied with the pressurized air from the air pump 1270, and thus, the piston 1254 or the piston 1256 is moved rightward moving the actuator rod 1210 in the same direction.

That is, when the ON-operation of the exhaust brake switch is carried out under a lower speed running of the motor vehicle, only the first working chamber 1260 is supplied with the pressurized air causing the first piston 1254 to move to the first stopper 1264. With this, the second piston 1256 is moved rightward by the first piston 1254 and thus the actuator rod 1210 is moved in the same direction to a position where the step 1210*b* of the actuator rod 1210 engages with the roller 1205 of the tappet 1204. Thus, under this condition, the exhaust valve 1100 assumes a slightly open position, and thus engine braking suitable for the lower vehicle speed is obtained.

While, when the ON-operation of the exhaust brake switch is carried out under a higher speed running of the vehicle, both the first and second working chambers 1260 and 1262 are supplied with the pressurized air. Thus, under this condition, both the first and second pistons 1254 and 1256 are moved rightward against the force of the spring 1268, and then only the second piston 1256 is moved rightward further against the spring 1268 separating from the stem 1257 of the first piston 1254, inducing a large rightward movement of the actuator rod 210 to a position where the step 1210*c* of the actuator rod 1210 engages with the roller 1205 of the tappet 1204. Thus, under this condition, the exhaust brake valve 1100 assumes a largely open position, and thus engine braking suitable for the higher vehicle speed is obtained.

However, due to inherent construction, the above-mentioned conventional decompression brake device has the following drawbacks.

First, due to usage of the exhaust brake valve 1100 in addition to the ordinary intake and exhaust valves for each combustion chamber, the engine is bulky in size and complicated in construction.

Second, the decompression brake device has a markedly elongated construction. That is, the valve drive mechanism 1200 has an elongated construction due to aligned arrangement of the actuator rod 1210 and the first and second pistons 1254 and 1256. Enlargement of the decompression brake device induces a difficulty in mounting the same to the engine.

Third, a fail-safe function is not expected in a failure of operation of the device under a high speed cruising. That is, if the second electromagnetic valve 1274 fails to operate, pressurized air can not be supplied to the second working chamber 1262. In this case, the actuator rod 1210 is forced to take the position where the step 1210*b* engages with the roller 1205 of the tappet 1204, and thus, the exhaust brake valve 1100 is forced to take the small open position even when the vehicle is running at a high speed. As is known, this is undesirable because under this condition a marked pressure in the combustion chamber is directly applied to the slightly opened exhaust brake valve 1100 and thus to the valve drive mechanism 1200 through the valve 1100. In fact, the valve 1100 kept in an opened position is unstable because it is not seated on a valve seat 1101.

SUMMARY OF THE INVENTION

It is therefore an object of the present invention to provide a decompression brake device of automotive engine, which is free of the above-mentioned drawbacks.

According to the present invention, there is provided a decompression brake device for use with an internal combustion engine having an exhaust valve, which comprises a valve drive mechanism for driving the exhaust valve, the valve drive mechanism having first, second and third conditions, the first condition being a condition wherein the exhaust valve assumes a fully closed rest position during intake, compression and expansion strokes of a corresponding engine cylinder and a full open position during an exhaust stroke of the engine cylinder, the second condition being a condition wherein the exhaust valve assumes the fully closed rest position during the intake stroke of the engine cylinder, a slightly open rest position during the compression and expansion strokes of the engine cylinder and the full open position during the exhaust stroke of the engine cylinder, and the third condition being a condition wherein the exhaust valve assumes the fully closed rest position during the intake of the engine, a largely open rest position during the compression and expansion strokes of the engine cylinder and the full open position during the exhaust stroke of the engine cylinder; an actuator having a hydraulically actuated rod which has first, second and third positions to cause the valve drive mechanism to assume the first, second and third conditions respectively; and a hydraulic circuit for feeding or drawing a pressurized oil to or from the actuator to move the rod to one of the first, second and third positions.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

As will be understood from the following description, in the present invention, an ordinary exhaust valve 21 of a combustion chamber is suitably controlled for establishing an engine braking in accordance with an engine speed. That is, in the invention, an exhaust brake valve exclusively used for the engine braking is not employed, unlike the case of the above-mentioned conventional decompression brake device.

Figure 1:
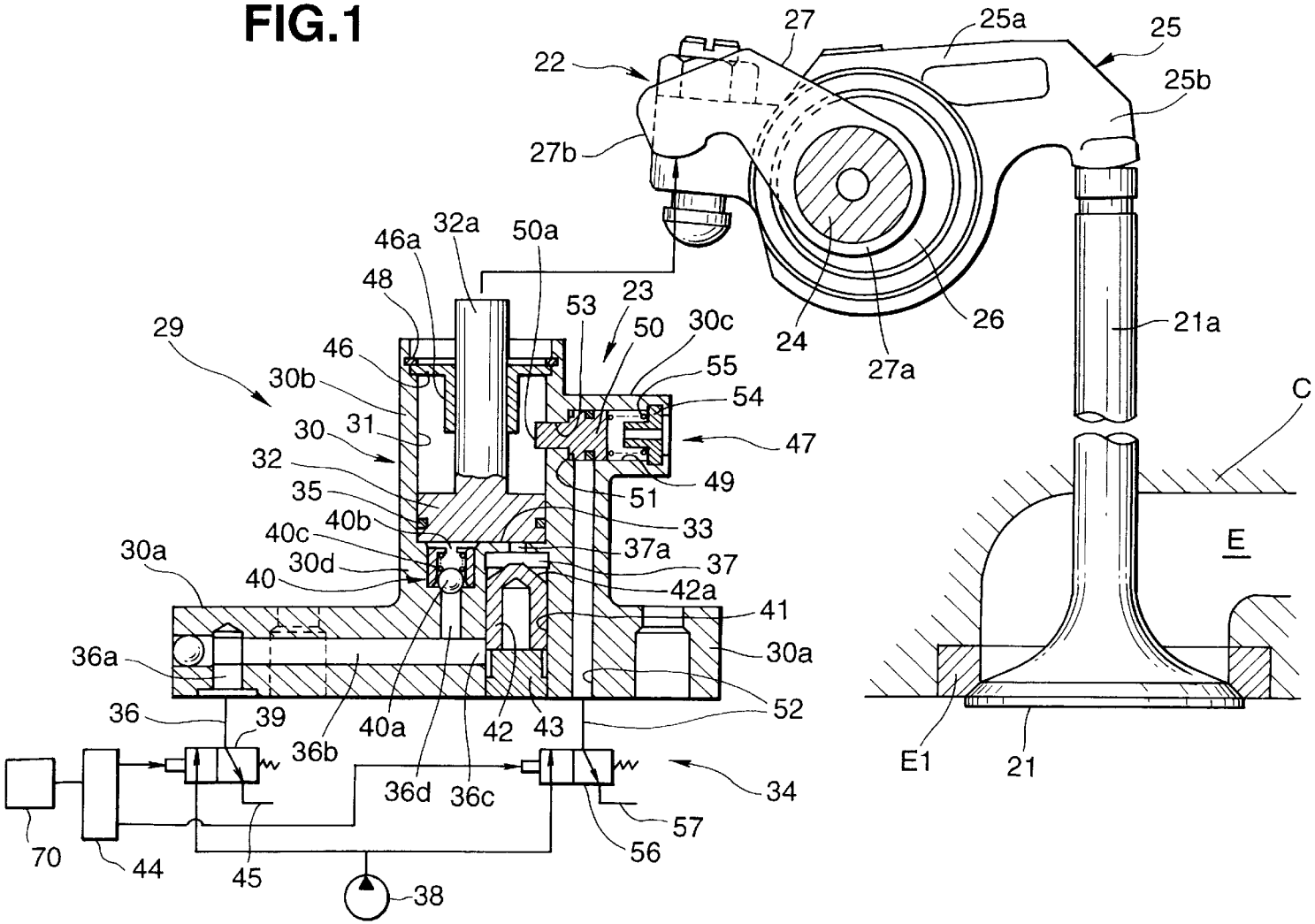
FIG. 1 is a sectional view of a decompression brake device of a first embodiment of the present invention, and a part of an internal combustion engine.

Referring to FIGS. 1 to 4, particularly FIG. 1 of the drawings, there is shown a decompression brake device of an internal combustion engine, which is a first embodiment of the present invention.

In FIG. 1, denoted by numeral 21 is an exhaust valve which opens and closes an exhaust port "E" formed in a cylinder head "C" in accordance with operation of an internal combustion engine. Denoted by numeral 22 is a valve drive mechanism for driving the exhaust valve 21, and denoted by numeral 23 is a valve rest position adjusting mechanism for adjusting a rest position of the exhaust valve 21 relative to a valve seat E1.

The valve drive mechanism 22 has first, second and third conditions. The first condition is a condition wherein the exhaust valve 21 for each engine cylinder assumes a fully closed rest position during intake, compression and expansion strokes of the cylinder and a fully open position during an exhaust stroke of the cylinder. The second condition is a condition wherein the exhaust valve 21 for each engine cylinder assumes the fully closed rest position during the intake stroke of the cylinder, a slightly open rest position during the compression and expansion strokes of the cylinder and the fully open position during the exhaust stroke of the cylinder. The third condition is a condition wherein the exhaust valve 21 for each engine cylinder assumes the fully closed rest position during the intake stroke of the cylinder, a largely open rest position during the compression and expansion strokes of the cylinder and the fully open position during the exhaust stroke of the cylinder. The valve drive mechanism of this type is substantially described in Japanese Patent First Provisional Publications 8-144729, 8-270424 and 6-17632.

That is, the valve drive mechanism 22 comprises a rocker shaft 24 extending axially over the cylinder head "C", a rocker arm 25 having one end 25*a* swingably supported by the rocker shaft 24 through a cam ring 26 and the other end 25*b* pressed against an upper end of a stem 21*a* of the exhaust valve 21, a lever 27 fixed at one end 27*a* thereof to one end portion of the rocker shaft 24 and an actuator 29 for pushing the other end 27*b* of the lever 27.

Figure 3:
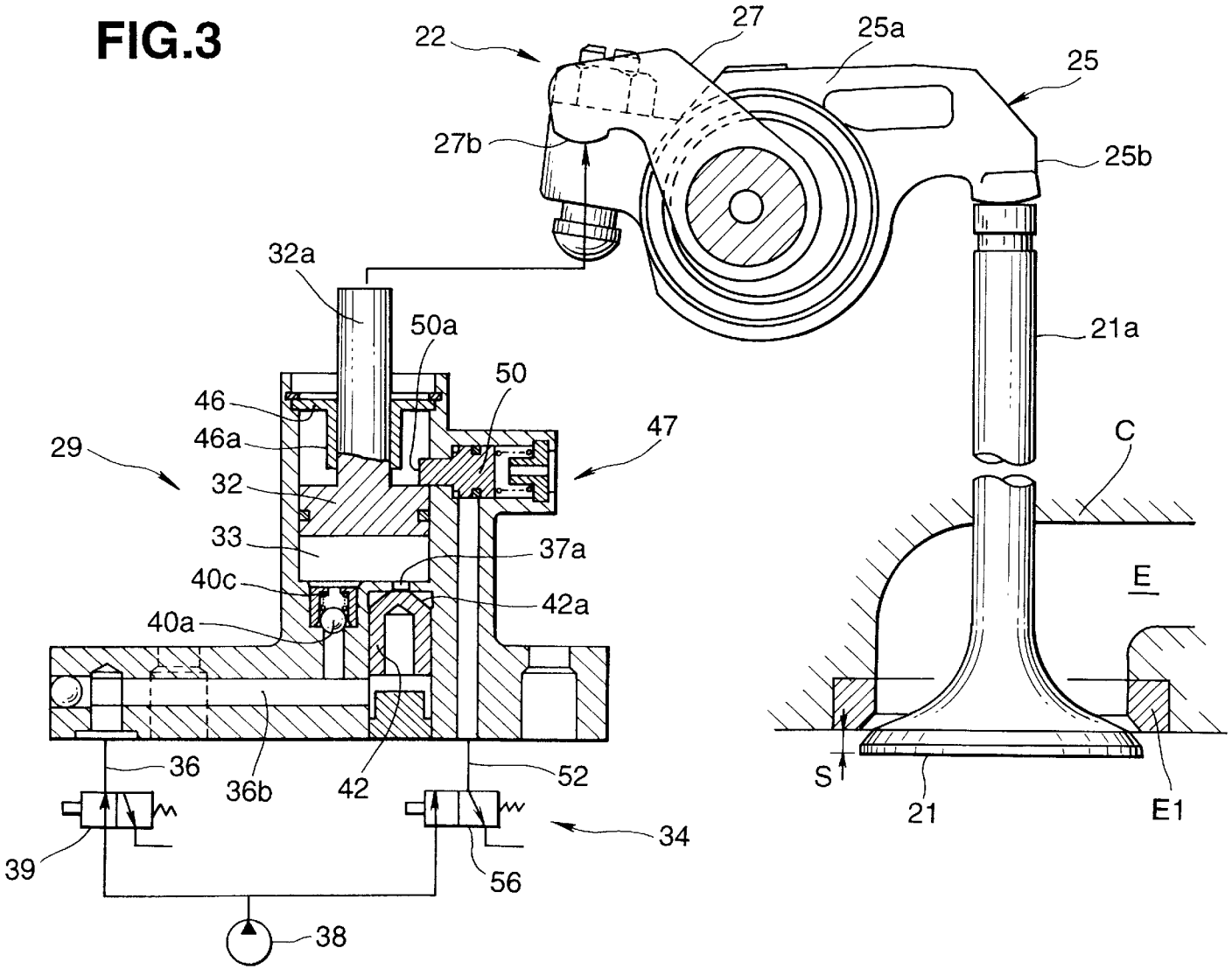
FIGS. 3 and 4 are views similar to FIG. 1, but showing different operating conditions of the decompression brake device of the first embodiment.
Figure 4:
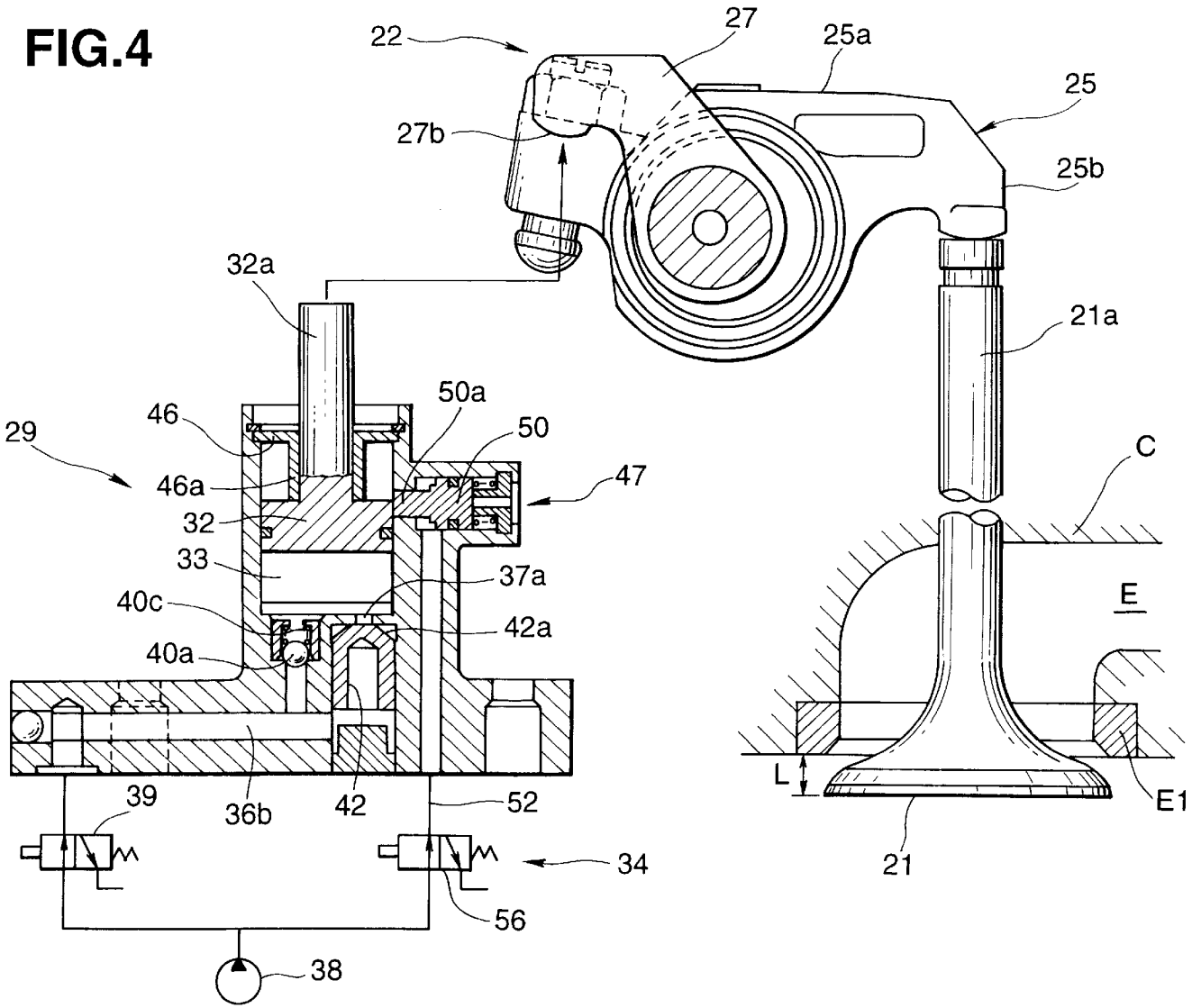

It is to be noted that when the other end 27*b* of the lever 27 assumes its lowermost position as shown in FIG. 1, the valve drive mechanism 22 is forced to take the above-mentioned first condition, when the other end 27*b* assumes its middle position as shown in FIG. 3, the valve drive mechanism 22 is forced to take the second condition and when the other end 27*b* assumes its uppermost position as shown in FIG. 4, the valve drive mechanism 22 is forced to take the third condition.

Although not shown in the drawings, a valve lifter and a push rod are arranged to swing the rocker arm 25 to induce synchronized open/close movements of the exhaust valve 21 in accordance with operation of the associated engine.

Figure 2:
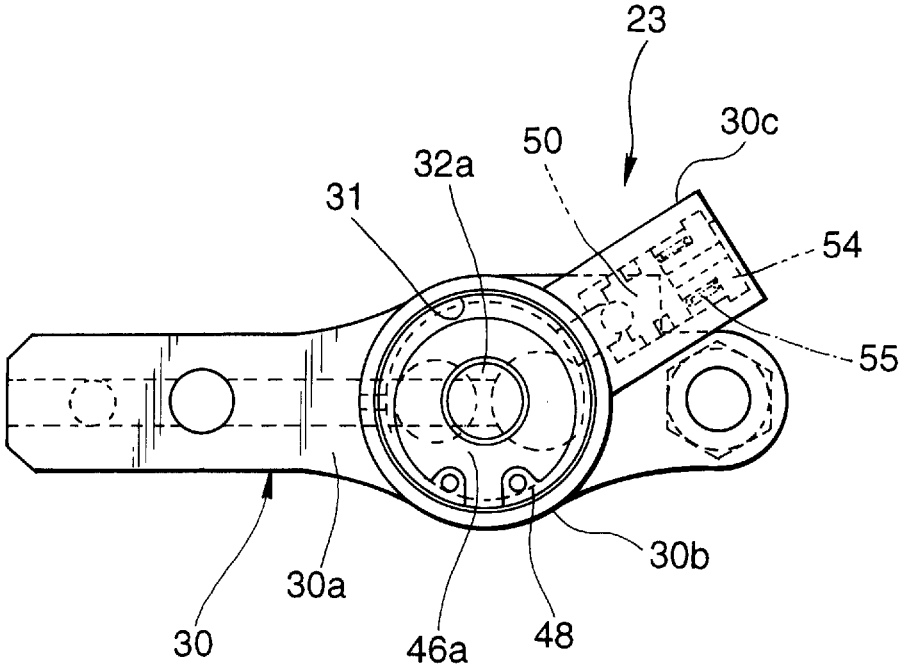
FIG. 2 is a plan view of a valve drive mechanism employed in the decompression brake device of the first embodiment.

As is best understood from FIGS. 2 and 3, the actuator 29 comprises a body 30 mounted on the cylinder head "C" through bolts (not shown). The body 30 is formed with a horizontal base portion 30*a* on which a vertical portion 30*b* is raised. The vertical portion 30*b* is formed at one side thereof with a cylindrical boss 30*c* for the purpose which will become apparent hereinafter. Within the vertical portion 30*b*, there is defined a cylindrical bore 31. A piston 32 is operatively disposed in the cylindrical bore 31 to define therebelow a hydraulic chamber 33. Denoted by numeral 34 is a hydraulic circuit which feeds or draws a working fluid into or from the hydraulic chamber 33 to move the piston 32.

The cylindrical bore 31 has a bottom wall 30*d* exposed to the hydraulic chamber 33. The cylindrical bore 31 has an upper open end which has an after-mentioned stopper member 46 plugged thereto. The piston 32 has a seal ring 35 disposed thereabout. The piston 32 is integrally formed with a piston rod 32*a* which has an upper end onto which the above-mentioned other end 27*b* of the lever 27 is put.

As is best understood from FIG. 1, the hydraulic circuit 34 comprises a fluid supplying passage 36 formed in both the cylinder head "C" and a cylinder block (not shown) of the engine, a fluid discharging passage 37 formed in the bottom wall 30*d*, an oil pump 38 positioned upstream of the fluid supplying passage 36 and a first electromagnetic valve 39 positioned downstream of the oil pump 38.

The fluid supplying passage 36 comprises a first vertical bore 36*a* formed in the horizontal base portion 30*a* of the body 30, an elongate horizontal bore 36*b* formed in the horizontal base portion 30*a* and a second vertical bore 36*d* formed in both the horizontal base portion 30*a* and the bottom wall 30*d*, these bores 36*a*, 36*b* and 36*d* being connected to provide a fluid communication between the first electromagnetic valve 39 and the hydraulic chamber 33. Designated by numeral 36*c* is a right end of the horizontal bore 36*b*.

The second vertical bore 36*d* is formed with an enlarged upper portion in which a check valve 40 is operatively installed to permit a fluid flow only in the direction of the hydraulic chamber 33. The check valve 40 comprises a check ball 40*a* movably put on an open end of the second vertical bore 36*d*, and a check spring 40*c* compressed between a retainer 40*b* and the ball 40*a* to bias the latter toward the open end.

Beside the second vertical bore 36*d* in the body 30, there is defined a piston bore 41 in which a free piston 42 is slidably received to open and close the above-mentioned fluid discharging passage 37. As is understood from FIG. 3, the piston bore 41 has a lower part merged with the right end 36*c* of the above-mentioned horizontal bore 36*b*. Thus, the free piston 42 moves upward and downward in the bore 41 to close and open the fluid discharging passage 37 in accordance with a pressure of the working fluid in the fluid supplying passage 36.

As shown, the free piston 42 has a conical head 42*a* which faces to a reduced portion 37*a* of the fluid discharging passage 37. The lowermost position of the free piston 42 can be adjusted by a plug 43 which closes the lower open end of the bore 41.

The above-mentioned first electromagnetic valve 39 is controlled by a controller 44 in a manner to selectively establish a communication between the fluid supplying passage 36 and the oil pump 38 or a communication between the fluid supplying passage 36 and a drain passage 45. In fact, the controller 44 controls the valve 39 in accordance with an engine speed sensed by a crank angle sensor 70.

The above-mentioned valve rest position adjusting mechanism 23 comprises a stopper member 46 plugged to the open upper end of the cylindrical bore 31, and a stopper mechanism 47 installed in the cylindrical boss 30*c* of the body 30. As will become apparent hereinafter, the stopper member 46 restricts the uppermost position of the piston 32 in the bore 31, and the stopper mechanism 47 restricts a middle position of the piston 32.

The stopper member 46 comprises a circular flange portion which is fixed to an inner wall of the bore 31 through a stopper ring 48 and a tubular portion 46*a* which extends downward from an opened center part of the flange portion to slidably receive the above-mentioned piston rod 32*a*. As is understood from FIG. 4, the uppermost position of the piston 32 is established when the piston 32 abuts against the lower end of the tubular portion 46*a*.

As is best seen from FIG. 4, the stopper mechanism 47 comprises generally a cylindrical bore 49 formed in the cylindrical boss 30*c*, a plunger 50 slidably disposed in the bore 49, and a fluid passage 52 leading to a hydraulic chamber 51 defined in the bore 49. The plunger 50 has a stopper pin 50*a* which can project into the cylindrical bore 31 through a small opening 53 formed through the cylindrical wall of the vertical portion 30*b*. An open right end of the cylindrical bore 49 of the boss 30*c* is closed by a plug 54. A spring 55 is compressed between the plug 54 and the plunger 50 to bias the plunger 50 leftward, that is, in the direction in which the stopper pin 50*a* projects into the cylindrical bore 31. The fluid passage 52 of the stopper mechanism 47 is connected to the oil pump 38 through a second electromagnetic valve 56. As is seen from FIG. 1, also the second electromagnetic valve 56 is controlled by the controller 44 in such a manner as to selectively establish a communication between the fluid passage 52 and the oil pump 38 or a communication between the fluid passage 52 and a drain passage 57.

It is to be noted that the electromagnetic valves 39 and 56 are of a type which establishes a drained condition of the associated passage 36 or 52 when fails to operate.

As will be described in the following, when the piston 32 assumes the lowermost position as shown in FIG. 1, the valve drive mechanism 22 takes the first condition, when the piston 32 assumes the middle position as shown in FIG. 3, the valve drive mechanism 22 takes the second condition and when the piston 32 assumes the uppermost position as shown in FIG. 4, the valve drive mechanism 22 takes the third condition. FIGS. 1, 3 and 4 respectively show the conditions of the exhaust valve 21 taken during compression and expansion strokes of each cylinder of the engine.

In the following, operation of the decompression brake device of the first embodiment will be described.

In a normal cruising condition of an associated motor vehicle wherein an accelerator pedal is kept depressed by a driver, the actuator 29 assumes a condition depicted by FIG. 1. That is, in such cruising condition, the controller 44 controls the first and second electromagnetic valves 39 and 56 in such a manner that the passages 36 and 52 are communicated with the drain passages 45 and 57 respectively. Under this condition, the piston 32 assumes the lowermost rest position and the plunger 50 assumes the leftmost projected position due to the force of the spring 55. That is, the other end 27*b* of the lever 27 assumes the lowermost position causing the valve drive mechanism 22 to take the first condition. That is, during intake, compression and expansion strokes of each cylinder of the engine, the intake valve 21 assumes the fully closed rest position. Thus, in this condition, engine braking to be effected by the decompression brake device is not carried out.

When, under a lower engine speed condition, the driver turns an exhaust brake switch (not shown) ON with his foot separated from the accelerator pedal, the controller 44 controls the first electromagnetic valve 39 in such a manner that the passage 36 is connected with the oil pump 38. Thus, the pressurized oil from the oil pump 38 is fed to the hydraulic chamber 33 through the check valve 40 and at the same time the pressurized oil is led to the piston chamber 41 to lift the free piston 42 to close the fluid discharging passage 37. Accordingly, the piston 32 is forced to move up to the middle position where it abuts against the projected pin 50*a* of the plunger 50. Thus, the other end 27*b* of the lever 27 is moved up to the middle position causing the valve drive mechanism 22 to take the second condition. Thus, thus engine braking suitable for a lower engine speed condition is obtained.

While, when, under a higher engine speed condition, the driver turns the exhaust brake switch ON with his foot separated from the accelerator pedal, the controller 44 controls both the first and second electromagnetic valves 39 and 56 in such a manner that both the passages 36 and 52 are communicated with the oil pump 38. Thus, the piston 32 is biased upward for the above-mentioned reason and at the same time, the pressurized oil from the oil pump 38 is fed into the hydraulic chamber 51 to move the plunger 50 to the rightmost retracted position against the spring 55. Thus, the piston 32 is moved up to the uppermost position and the other end 27*b* of the lever 27 is moved up to the uppermost position causing the valve drive mechanism 22 to take the third condition. Accordingly, engine braking suitable for a higher engine speed condition is obtained.

When now the engine speed is lowered to a lower engine speed range, the controller 44 switches the first electromagnetic valve 39 in such a manner as to connect the passage 36 with the drain passage 45. With this, the piston 32 is lowered forcing the oil in the hydraulic chamber 33 into an oil pan (not shown) through the oil discharging passage 37. Once the piston 32 is lowered to a position below the stopper pin 50*a* kept retracted, the controller 44 controls the first and second electromagnetic valves 39 and 56 in such a manner that the piston 32 takes the above-mentioned middle position. With this, the valve drive mechanism 22 assumes the second condition.

When the driver turns the engine brake switch OFF, the controller 44 controls the first and second electromagnetic valves 39 and 56 in such a manner that the decompression brake device assumes the above-mentioned condition of FIG. 1.

As is described hereinabove, due to work of the decompression brake device, the associated internal combustion engine can exhibit two engine braking modes in accordance with the engine speed, in addition to a normal engine braking mode.

As is seen FIG. 1, the parts of the actuator 29 are compactly housed in both the horizontal and vertical portions of the body 30. This brings about a compact construction of entire of the decompression brake device.

Because the two electromagnetic valves 39 and 56 are of a type which establishes a drained condition of an associated passage 36 or 52 when deenergized, a fail-safe function is possessed by the decompression brake device. That is, when the controller 44 fails to energize the valves 36 and 52 under need of engine braking, the drain condition is established and thus the valve drive mechanism 22 is forced to take the first condition. Thus, ordinary engine braking is obtained.

Due to usage of the free piston 42, movement of the piston 32 is smoothly carried out without delay, which brings about a high responsibility of the decompression brake device. The conical head 42*a* of the free piston 42 induces an assured closing of the reduced portion 37*a* of the fluid discharging passage 37.

Figure 5:
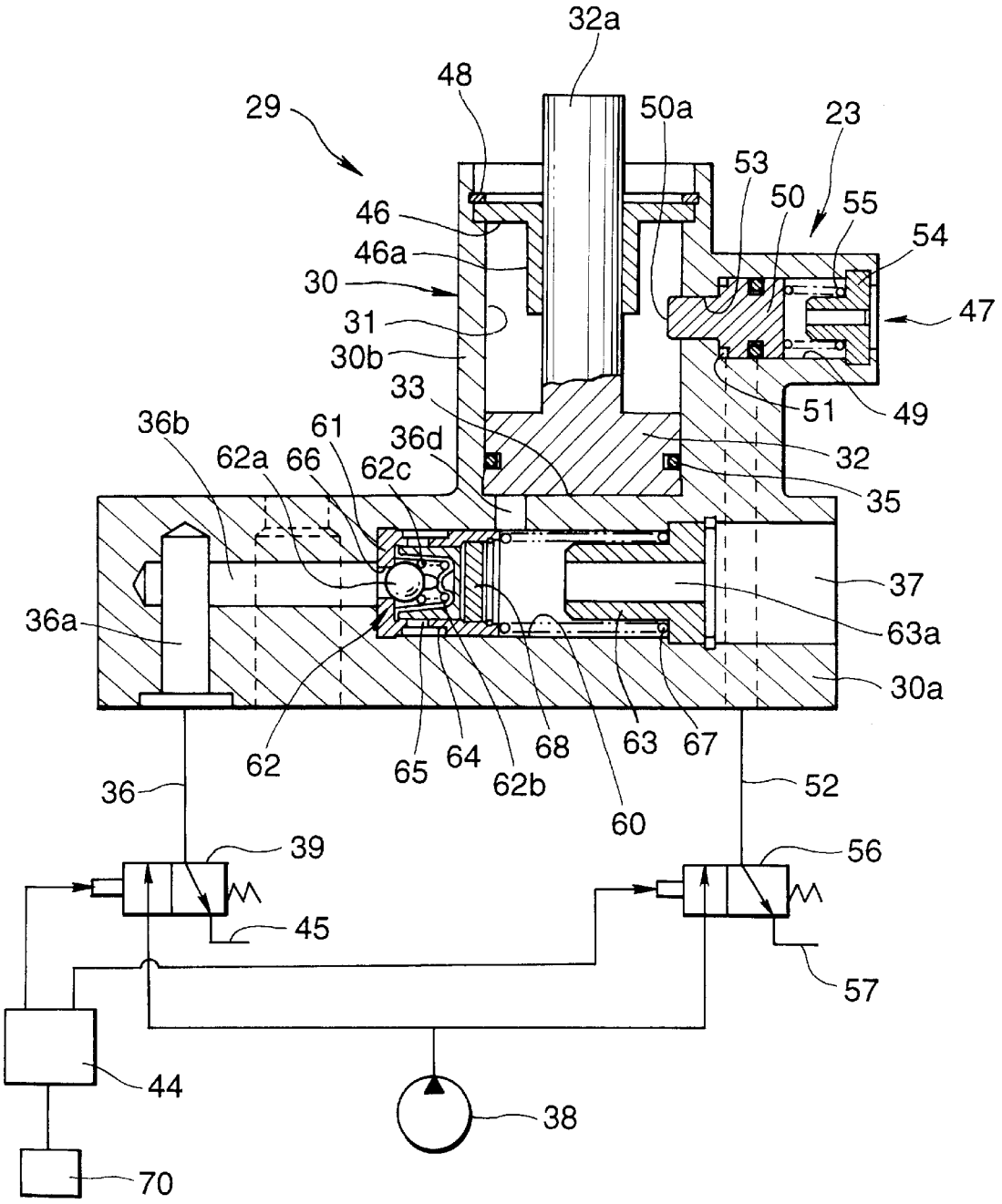
FIG. 5 is a sectional view of a decompression brake device of a second embodiment of the present invention.
Figure 6:
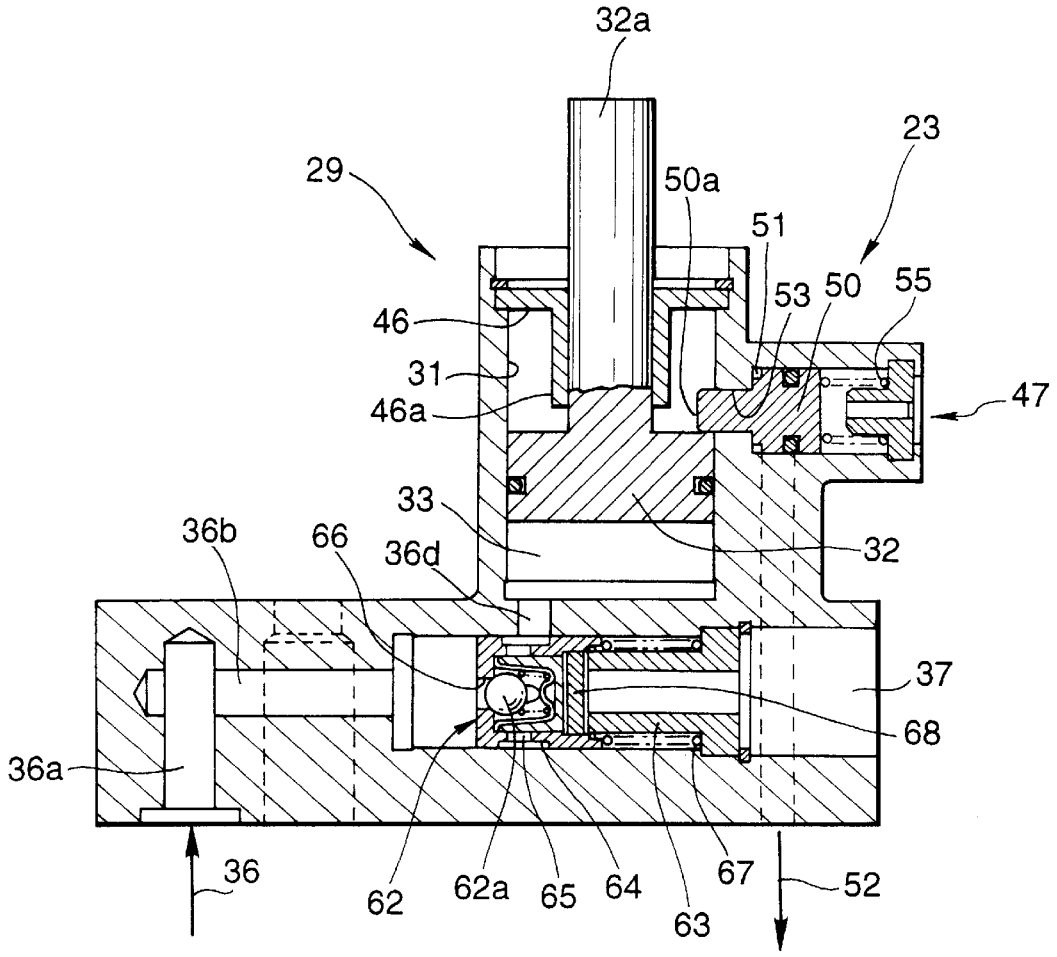
FIGS. 6 and 7 are views similar to FIG. 5, but showing different operating conditions of the decompression brake device of the second embodiment.
Figure 7:
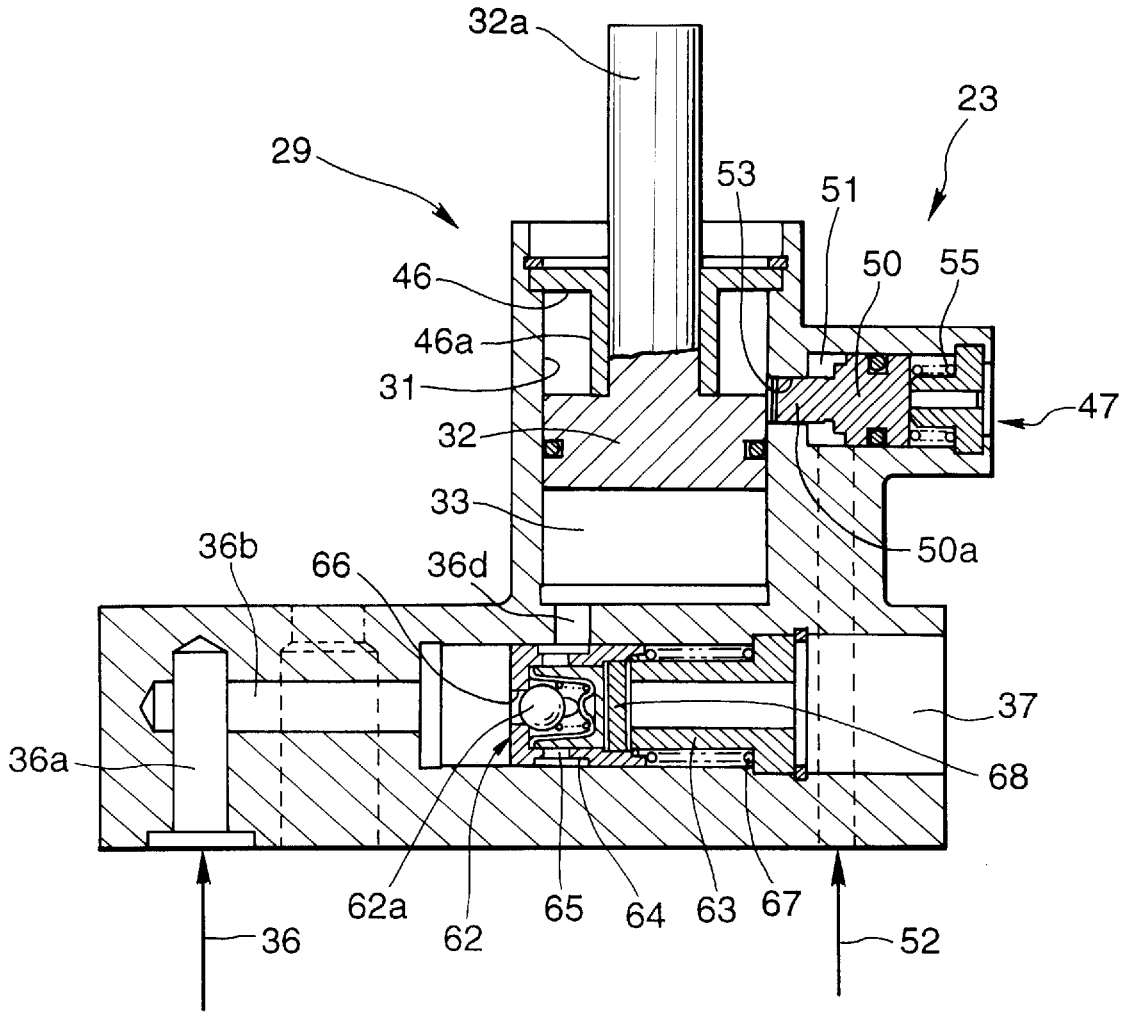

Referring to FIGS. 5 to 7, particularly FIG. 5, there is shown a decompression brake device which is a second embodiment of the present invention.

Since the decompression brake device of this second embodiment is similar to that of the above-mentioned first embodiment, only portions and parts different front those of the first embodiment will be described in the following. Substantially same portions and parts are denoted by the same numerals. In fact, the stopper mechanism 47 of the valve rest position adjusting mechanism 23 and the hydraulic circuit 34 are substantially the same as those of the first embodiment.

As is seen from FIG. 5, in this second embodiment, the elongate horizontal bore 36*b* of the body 30 has an enlarged bore portion 60 in which a spool valve 61 and a check valve 62 are installed, in place of the free piston 42 employed in the above-mentioned first embodiment.

The enlarged bore portion 60 has a middle portion connected to the hydraulic chamber 33 of the piston 32 through a vertical bore 36*d*. The enlarged bore portion 60 has a right open end 37 in which an apertured spring holder 63 is fixed. Thus, a left part of the enlarged bore portion 60 is communicated with the right open end 37 through the aperture 63*a* of the spring holder 63, as shown. The right open end 37 serves as a drain port.

The spool of the spool valve 61 slides in the left part of the enlarged bore portion 60 and has an annular groove 64 formed therearound. The annular groove 64 is communicated with an interior of the spool of the valve 61 through radial openings 65 formed in a cylindrical wall of the spool of the valve 61. The spool of the valve 61 has at a front center portion thereof an opening 66 which faces a right end of the horizontal bore 36*b*. A coil spring 67 is compressed between the spring holder 63 and the spool of the valve 61 to bias the spool leftward to a position to connect the interior of the enlarged bore portion 60 with the vertical bore 36*d*, as shown in FIG. 5. A right open end of the spool of the valve 61 is hermetically closed by a plate 68.

The check valve 62 is movably installed in the spool of the valve 61, which comprises a check ball 62*a* which is biased toward the opening 66 by a spring 62*c* compressed between the check ball 62*a* and a spring retainer 62*b*.

Under normal cruising of an associated motor vehicle, the actuator 29 in this second embodiment assumes a condition depicted by FIG. 5. That is, in such cruising condition, the controller 44 establishes a drained condition in both the hydraulic chamber 33 and the hydraulic chamber 51 of the bore 49. Thus, the piston 32 takes its lowermost position and thus the valve drive mechanism 22 is force to take the first condition. Thus, in this condition, engine braking expected by the decompression brake device is not carried out.

When, under a lower engine speed condition, the driver turns the exhaust brake switch ON, the controller 44 controls the first electromagnetic valve 39 in such a manner that the passage 36 is communicated with the oil pump 38. With this, the piston 32 takes the middle position, as is shown in FIG. 6, for substantially the same reason as has been described in the above-mentioned first embodiment. Thus, the valve drive mechanism 22 takes the second condition and thus, engine braking suitable for a lower engine speed condition is obtained.

While, when, under a higher engine speed condition, the driver turns the exhaust brake switch ON, the controller 44 controls the first and second electromagnetic valves 39 and 56 in such a manner that both the passages 36 and 52 are communicated with the oil pump 38. With this, the piston 32 takes the uppermost position, as is shown in FIG. 7, for substantially the same reason as has been described in the first embodiment. Thus, the valve drive mechanism 22 takes the third condition, and thus engine braking suitable for a higher engine speed condition is obtained.

Figure 8:
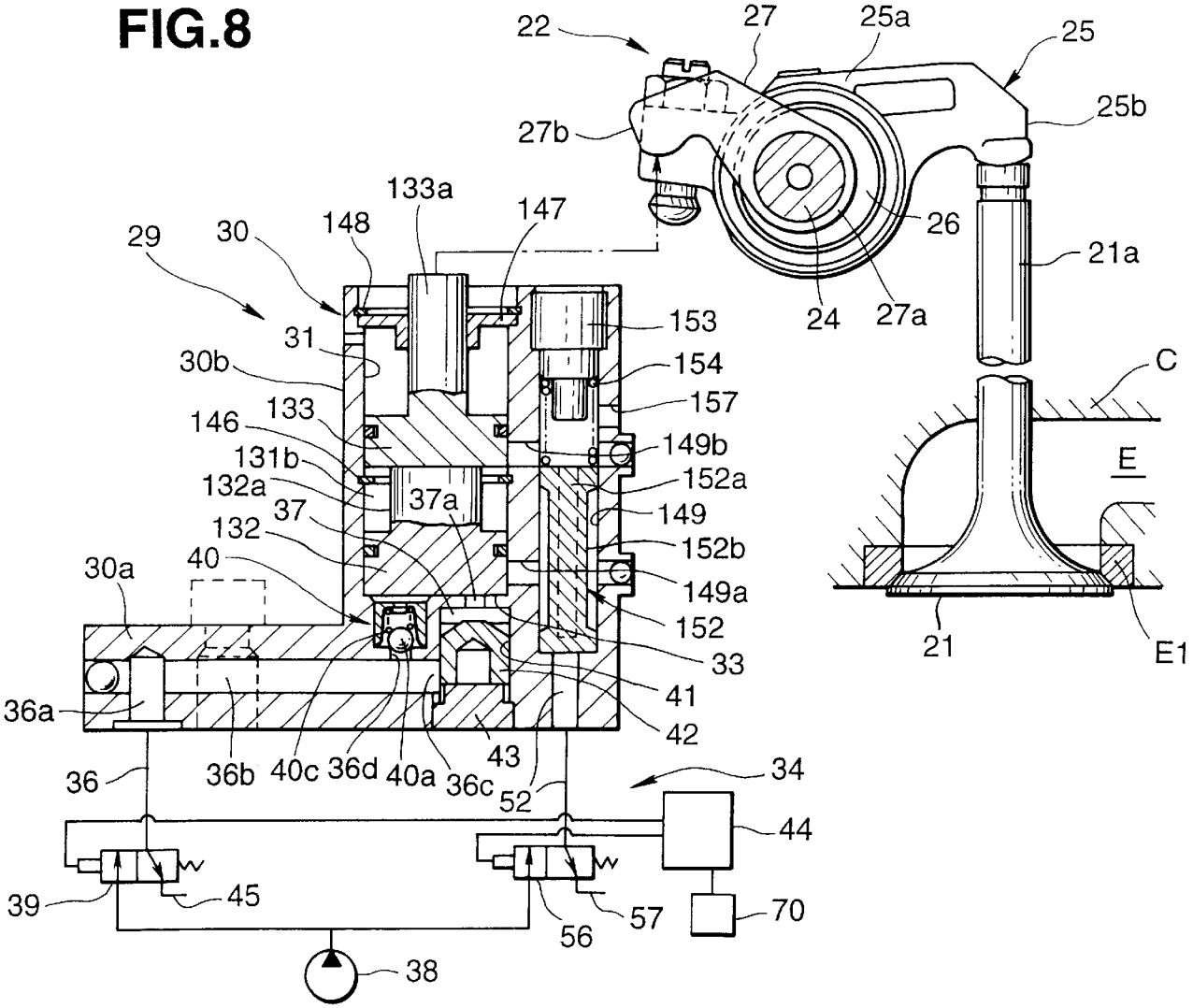
FIG. 8 is a sectional view of a decompression brake device of a third embodiment of the present invention, and a part of an internal combustion engine.

Referring to FIGS. 8 to 11, particularly FIG. 8, there is shown a decompression brake device which is a third embodiment of the present invention.

Since the decompression brake device of this third embodiment is similar to that of the above-mentioned first embodiment, only portions and parts different from those of the first embodiment will be described in the following. Thus, substantially same portions and parts are denoted by the same numerals.

As shown in FIG. 8, in this third embodiment, two, that is, first and second pistons 132 and 133 are coaxially and slidably received in the cylindrical bore 31. As shown, the first piston 132 is positioned below the second piston 133. Thus, the hydraulic chamber 33 mated with the reduced portion 37*a* of the fluid discharging passage 37 is positioned below the first piston 132. For ease of understanding, the hydraulic chamber 33 will be denoted by "first hydraulic chamber" and the reduced portion 37*a* of the fluid discharging passage 37 will be denoted by "first fluid discharging opening" in this third embodiment. Between the first and second pistons 132 and 133, there is defined a second hydraulic chamber 131*b*. The first piston 132 has a stem 132*a* projected toward the second piston 133, and the second piston 133 has a piston rod 133*a* which has an upper end onto which the end 27*b* of the lever 27 is put. Each piston 132 or 133 has a seal ring (no numeral) disposed thereabout. Within the cylindrical bore 31, there are installed first and second stopper members 146 and 147 for restricting uppermost positions of the first and second pistons 132 and 133 respectively.

Figure 9:
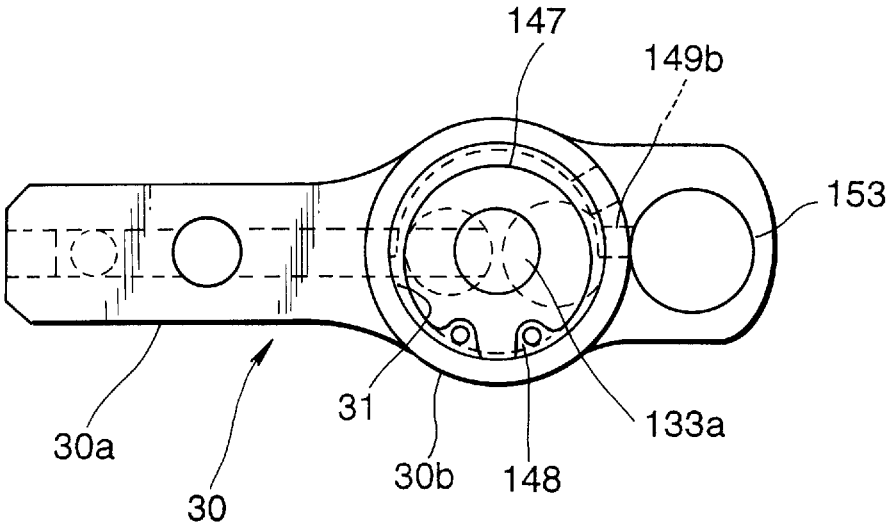
FIG. 9 is a plan view of a valve drive mechanism employed in the decompression brake device of the third embodiment.
Figure 10:
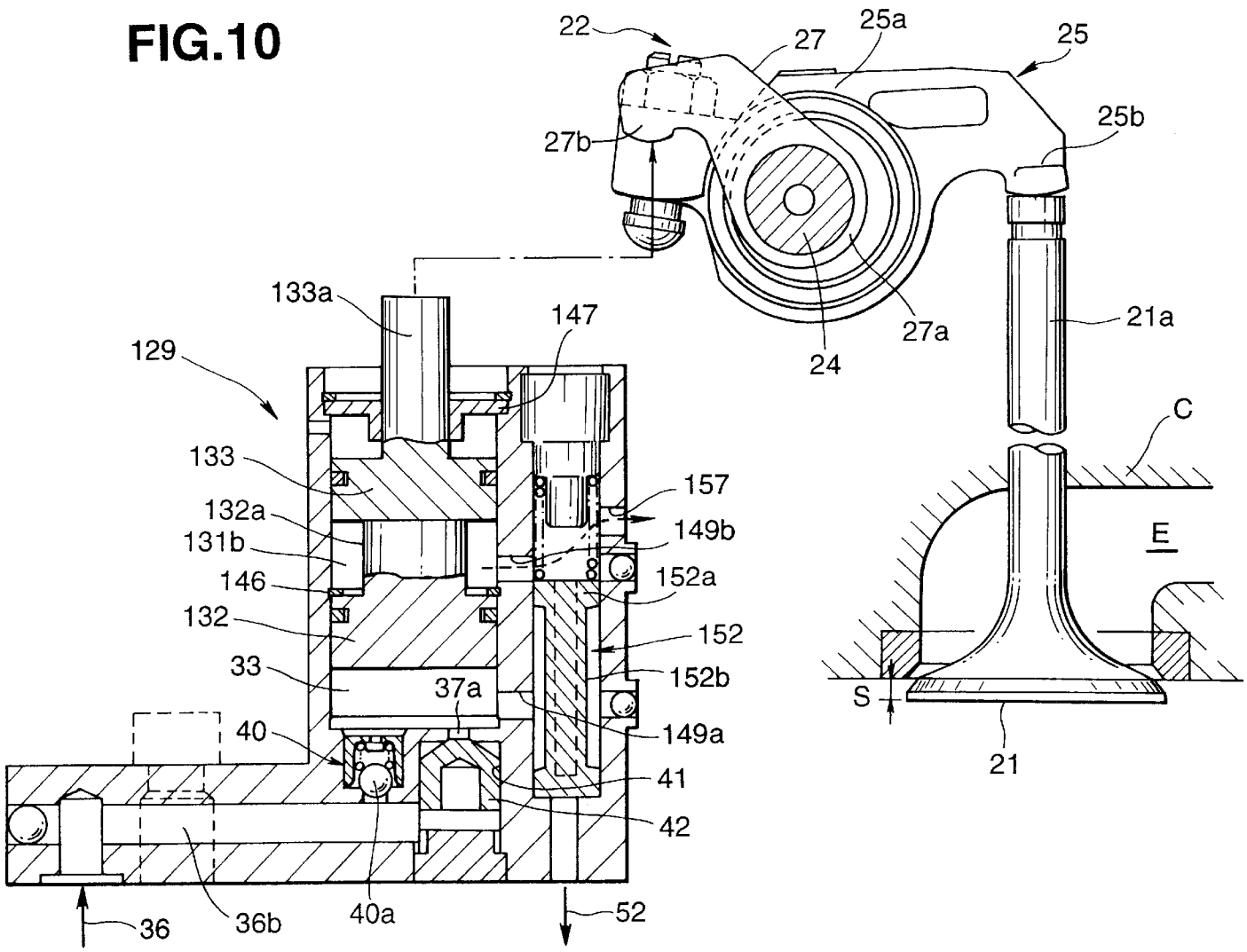
FIGS. 10 and 11 are views similar to FIG. 8, but showing different operating conditions of the decompression brake device of the third embodiment.
Figure 11:
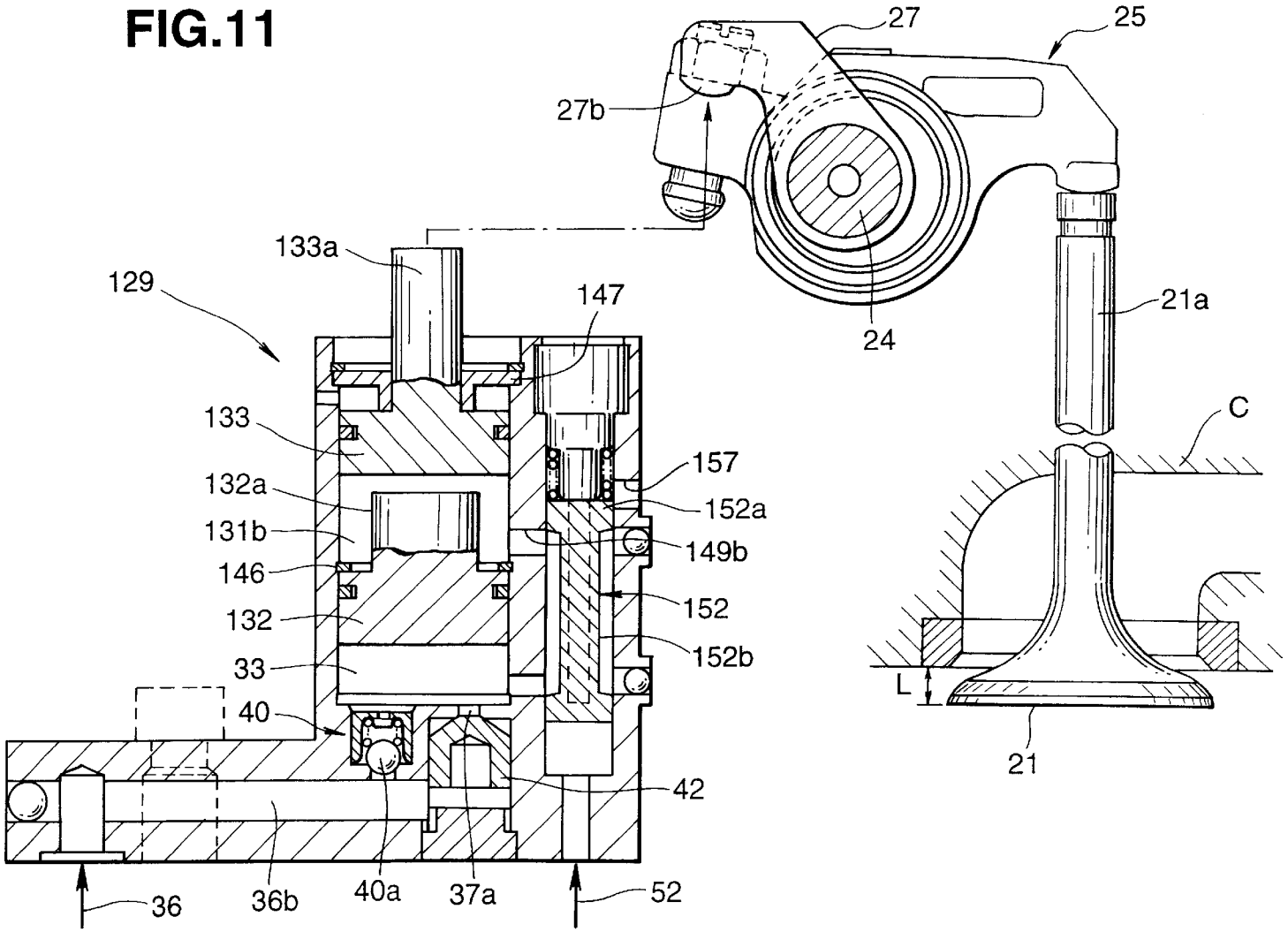

As is seen from FIGS. 8 and 9, the vertical portion 30*b* of the body 30 is formed with a vertically extending bore 149. The bore 149 is communicated with the first and second hydraulic chambers 33 and 131*b* through first and second openings 149*a* and 149*b* formed in a wall arranged between the cylindrical bore 31 and the bore 149, as shown. An upper open end of the bore 149 is closed by a plug 153. A spool 152*a* of a spool valve 152 is slidably received in the bore 149, which is biased downward by a coil spring 154 compressed between the plug 153 and the spool 152*a*. The spool 152*a* is formed with an annular groove 152*b* which can connect the first and second openings 149*a* and 149*b* when the spool 152*a* assumes its uppermost position in the bore 149. A second fluid discharging opening 157 is formed in the wall of the bore 149 above the second opening 149*b*. A lower portion of the bore 149 is connected to the second electromagnetic valve 56 through the fluid passage 52.

In the following, operation of the decompression brake device of the third embodiment will be described.

In a normal cruising condition of an associated motor vehicle wherein an accelerator pedal is kept depressed by a driver, the actuator 29 assumes a condition depicted by FIG. 8. That is, in such cruising condition, the controller 44 controls the first and second electromagnetic valves 39 and 56 in such a manner that the passages 36 and 52 are communicated with the drain passages 45 and 57 respectively. Under this condition, the first and second pistons 132 and 133 assume their lowermost rest positions and the spool 152*a* of the spool valve 152 assumes its lowermost position due to force of the spring 154. That is, the second piston 133 assumes its lowermost position and thus the other end 27*b* of the lever 27 takes its lowermost position. Accordingly, the valve drive mechanism 22 is forced to assume the first condition. Thus, in this condition, engine braking to be effected by the decompression brake device is not carried out.

When, under a lower engine speed condition, the driver turns an exhaust brake switch ON with his foot separated from the accelerator pedal, the controller 44 controls the first electromagnetic valve 39 in such a manner that the passage 36 is communicated with the oil pump 38. Thus, the pressurized oil from the oil pump 38 is fed to the first hydraulic chamber 33 through the check valve 40 and at the same time the pressurized oil is led into the piston chamber 41 to lift the free piston 42 to close the first fluid discharging opening 37*a*. Accordingly, as is understood from FIG. 10, the first piston 132 is forced to assume its uppermost position restricted by the first stopper member 146 and thus the second piston 133 is forced to assume its middle position projecting the piston rod 133*a* thereof to a middle position. Thus, the other end 27*b* of the lever 27 takes the middle position. Thus, the valve drive mechanism 22 is forced to take the above-mentioned second condition and thus engine braking suitable for a lower engine speed is obtained. During this, the spool 152*a* of the spool valve 152 is kept in its lowermost position keeping the disconnection between the first and second openings 149*a* and 149*b*.

While, when, under a higher engine speed condition, the driver turns the exhaust brake switch ON with his foot separated from the accelerator pedal, the controller 44 controls both the first and second electromagnetic valves 39 and 56 in such a manner that the passages 36 and 52 are communicated with the oil pump 38. Thus, as is understood from FIG. 11, the first piston 132 is forced to assume its uppermost position for the above-mentioned reason and at the same time due to upward movement of the spool 152*a* of the spool valve 152, the pressurized oil in the first hydraulic chamber 33 is led into the second hydraulic chamber 131*b* through the annular groove 152*b* of the spool 152*a*, so that the second piston 133 is forced to assume its uppermost position restricted by the second stopper member 147, projecting the piston rod 133*a* thereof to an uppermost position. Thus, the other end 27*b* of the lever 27 takes its uppermost position, and thus the valve drive mechanism 22 is forced to take the above-mentioned third condition. Thus, under this condition, engine braking suitable for a higher engine speed is obtained.

When now the engine speed is lowered to a lower engine speed range, the controller 44 switches the second electromagnetic valve 56 in such a manner as to connect the passage 52 with the drain passage 57. With this, the spool 152*a* of the spool valve 152 is moved to the lowermost position due to force of the spring 154, while shutting off the communication between the first and second hydraulic chambers 33 and 131*b* and connecting the second hydraulic chamber 131*b* with the second fluid discharging passage 157. Thus, the second piston 133 is lowered to its middle position restricted by the first piston 132, while forcing the oil in the second hydraulic chamber 131*b* into an oil pan (not shown) through the second fluid discharging passage 157. Thus, thereafter, the valve drive mechanism 22 takes the second position.

When the driver turns the engine brake switch OFF, the controller 44 controls the first and second electromagnetic valves 39 and 56 in such a manner that the decompression brake device assumes the above-mentioned condition of FIG. 8. Thus, the valve drive mechanism 22 is forced to take the first condition.

In the third embodiment, due to usage of the interacting two pistons 132 and 133, much precise positioning of the exhaust valve 21 is obtained.

Figure 12:
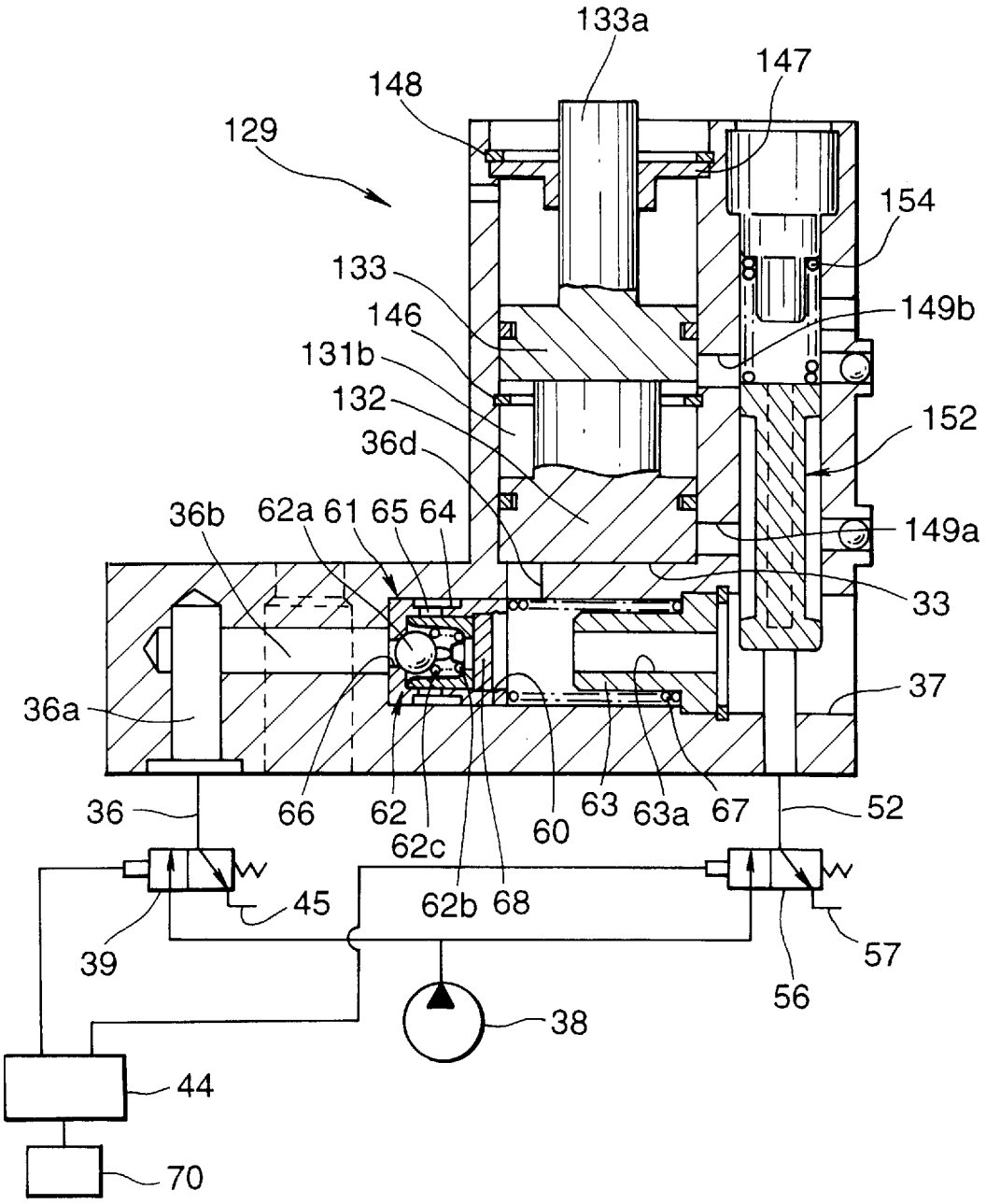
FIG. 12 is a sectional view of a decompression brake device of a fourth embodiment of the present invention.
Figure 13:
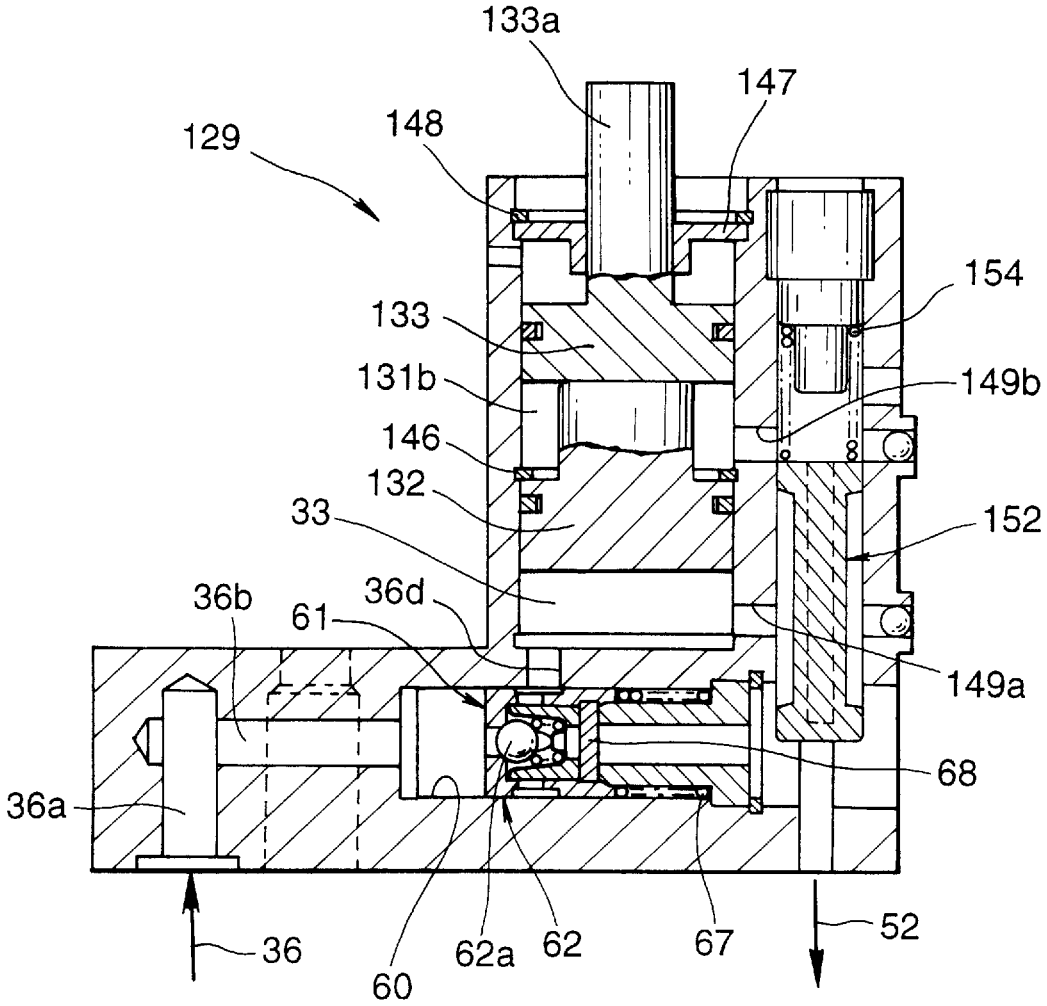
FIGS. 13 and 14 are views similar to FIG. 12, but showing different operating conditions of the decompression brake device of the fourth embodiment.
Figure 14:
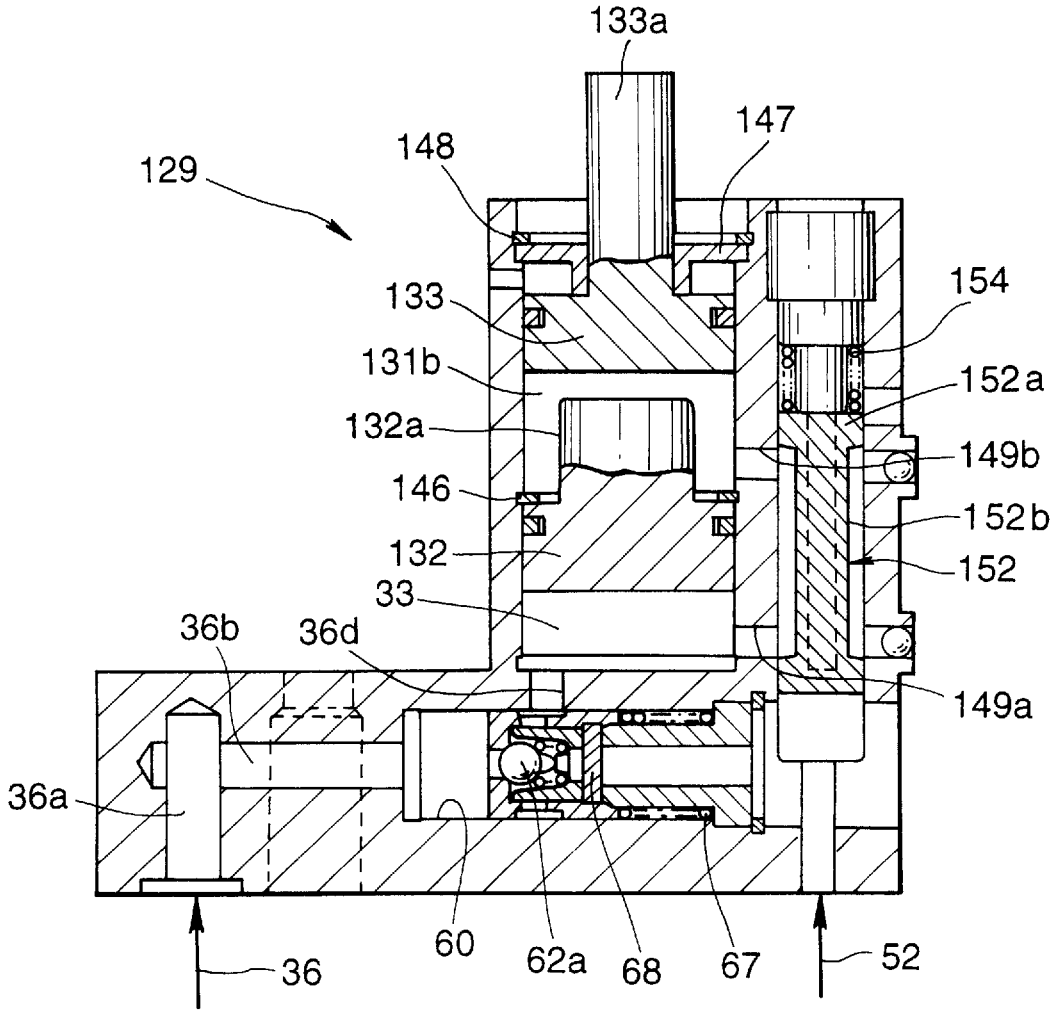

Referring to FIGS. 12 to 14, particularly FIG. 12, there is shown a decompression brake device which is a fourth embodiment of the present invention.

Since the decompression brake device of this fourth embodiment is similar to that of the above-mentioned third embodiment of FIG. 8, only portions and parts different from those of the third embodiment will be described in the following. Substantially same portions and parts are denoted by the same numerals as in the third embodiment.

As is seen from FIG. 12, in this fourth embodiment, the elongate horizontal bore 36*b* of the body 30 has an enlarged bore portion 60 in which a spool valve 61 and a check valve 62 are installed, in place of the free piston 42 employed in the third embodiment.

The enlarged bore portion 60 has a middle portion connected to the first hydraulic chamber 33 of the first piston 132 through a vertical bore 36*d*. The enlarged bore portion 60 has a right open end 37 in which an apertured spring holder 63 is fixed. Thus, a left part of the enlarged bore portion 60 is communicated with the right open end 37 through the aperture 63*a* of the spring holder 63, as shown. The right open end 37 serves as a drain port.

The spool of the spool valve 61 slides in the left part of the enlarged bore portion 60 and has an annular groove 64 formed therearound. The annular groove 64 is communicated with an interior of the spool through radial openings 65 formed in a cylindrical wall of the spool. The spool of the valve 61 has at a front center portion thereof an opening 66 which faces a right end of the horizontal bore 36*b*. A coil spring 67 is compressed between the spring holder 63 and the spool of the valve 61 to bias the spool leftward to a position to connect the interior of the enlarged bore portion 60 with the vertical bore 36*d*, as shown in FIG. 12. A right open end of the spool of the valve 61 is hermetically closed by a plate 68.

The check valve 62 is movably installed in the spool of the valve 61, which comprises a check ball 62*a* which is biased toward the opening 66 by a spring 62*c* compressed between the check ball 62*a* and a spring retainer 62*b*.

Under normal cruising of an associated motor vehicle, the actuator 129 in this fourth embodiment assumes a condition depicted by FIG. 12. That is, in such cruising condition, the controller 44 establishes a drained condition in both the horizontal bore 36*b* and the vertically extending bore 149. Thus, the second piston 133 assumes its lowermost position, and thus the valve drive mechanism 22 is forced to assume the first condition. Thus, in this condition, engine braking expected by the decompression brake device is not carried out.

When, under a lower engine speed condition, the driver turns the exhaust brake switch ON, the controller 44 controls the first electromagnetic valve 39 in such a manner that the passage 36 is communicated with the oil pump 38. With this, the first piston 132 takes its uppermost position lifting the second piston 133 to the middle position, as is shown in FIG. 13, for substantially the same reason as has been described in the above-mentioned third embodiment. Thus, the valve drive mechanism 22 is forced to assume the second condition and thus, engine braking suitable for a lower engine speed condition is obtained.

While, when, under a higher engine speed condition, the driver turns the exhaust brake switch ON, the controller 44 controls the first and second electromagnetic valves 39 and 56 in such a manner that both the passages 36 and 52 are communicated with the oil pump 38. With this, the first piston 132 assumes its uppermost position and the second piston 133 assumes its uppermost position separating from the first piston 132, as is shown in FIG. 14. Thus, the valve drive mechanism 22 is forced to take the third condition, and thus, engine braking suitable for a higher engine speed condition is obtained.

Figure 15:
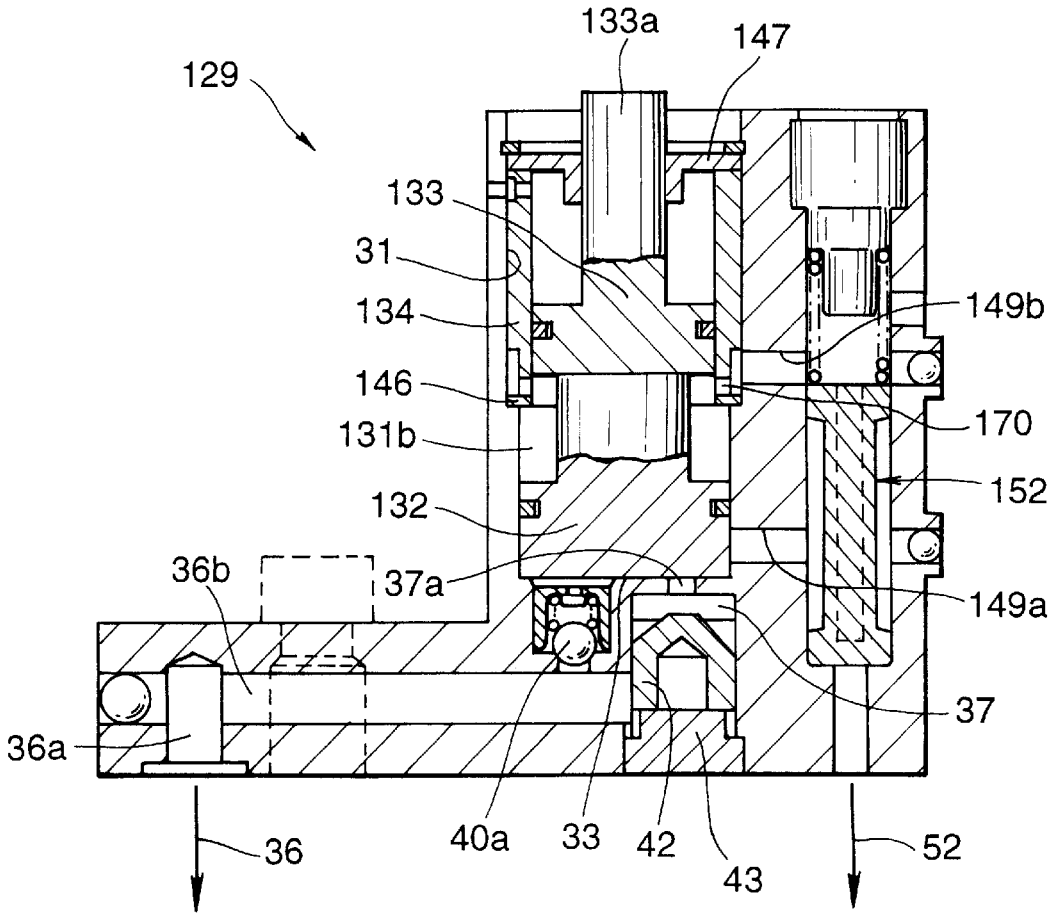
FIG. 15 is a sectional view of a decompression brake device of a fifth embodiment of the present invention.

Referring to FIG. 15, there is shown a decompression brake device which is a fifth embodiment of the present invention.

Since the decompression brake device of this fifth embodiment is similar to that of the above-mentioned third embodiment of FIG. 8, only portions and parts different from those of the third embodiment will be described in the following. Substantially same portions and parts are denoted by the same numerals as in the third embodiment.

As is seen from FIG. 15, in this fifth embodiment, a separate cylinder member 134 is coaxially and tightly received in an upper portion of the cylindrical bore 31. For receiving the member 134, the upper portion of the bore 31 is somewhat enlarged, as shown. A lower end of the separate cylinder member 134 projects into the second hydraulic chamber 131*b* to serve as a stopper member for the first piston 132. The separate cylinder member 134 has near the lower end thereof an opening 170 through which the chamber 131*b* is connected with the second opening 149*b*. The second piston 133, which is somewhat reduced in size, is slidably received in the cylinder member 134. Of course, the device of this fifth embodiment operates in the same manner as that of the third embodiment.

Figure 16:
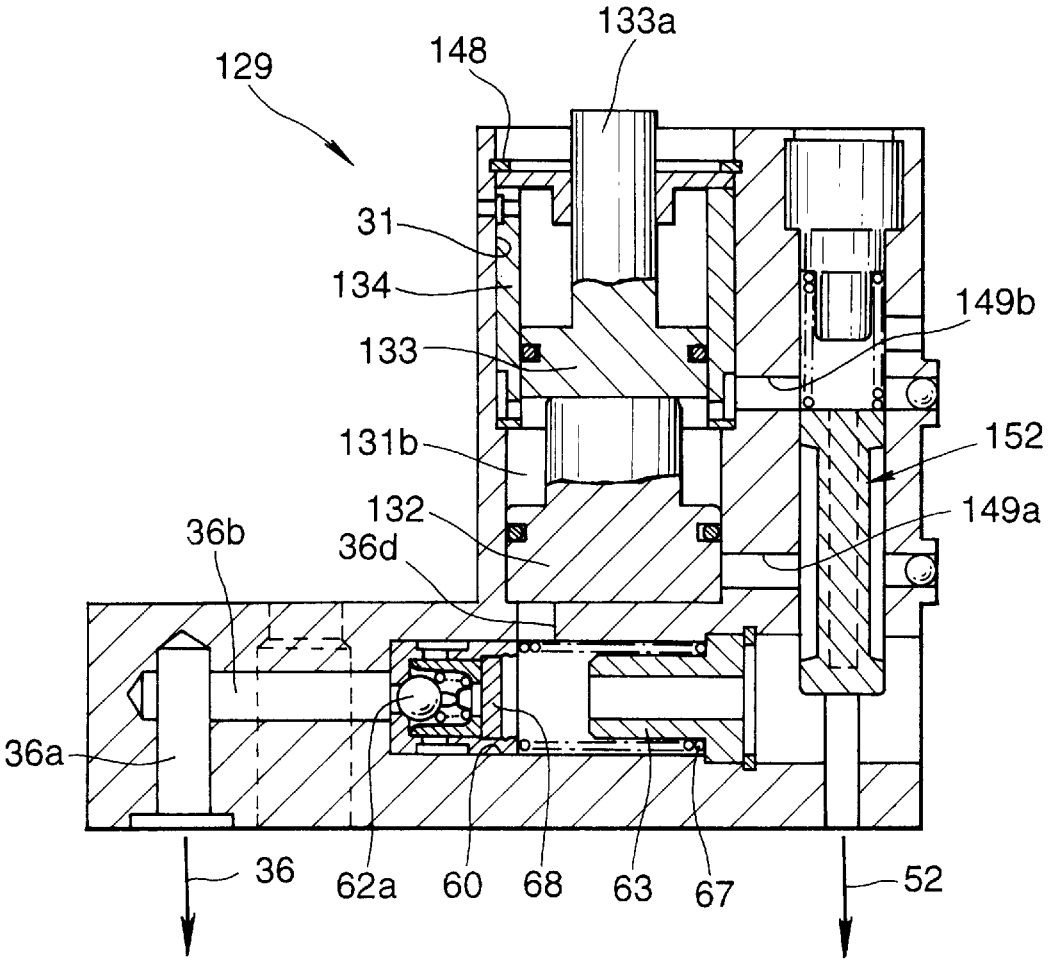
FIG. 16 is a view similar to FIG. 15, but showing a sixth embodiment of the present invention.

Referring to FIG. 16, there is shown a decompression brake device which is a sixth embodiment of the present invention.

Since the decompression brake device of this sixth embodiment is similar to that of the above-mentioned fourth embodiment of FIG. 12, only portions and parts different from those of the fourth embodiment will be described. Substantially same portions and parts are denoted by the same numerals as in the fourth embodiment.

As is seen from FIG. 16, in this sixth embodiment, a separate cylinder member 134 is coaxially and tightly received in an upper portion of the cylindrical bore 31. For receiving the member 134, the upper portion of the bore 31 is somewhat enlarged, as shown. A lower end of the separate cylinder member 134 projects into the second hydraulic chamber 131*b* to serve as a stopper member for the first piston 132. The separate cylinder member 134 has near the lower end thereof an opening 170 through which the chamber 131*b* is connected with the second opening 149*b*. The second piston 133, which is somewhat reduced in size, is slidably received in the cylinder member 134. Of course, the device of this sixth embodiment operates in the same manner as that of the fourth embodiment.

Figure 17:
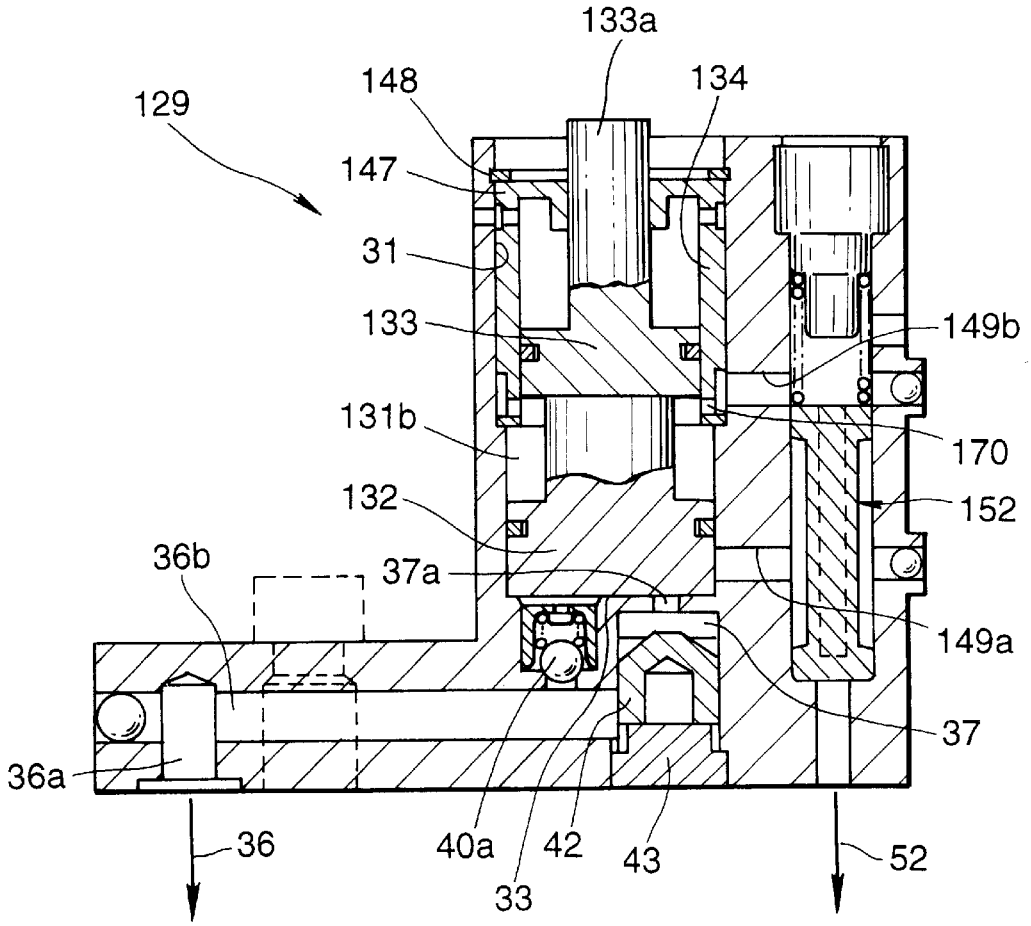
FIG. 17 is a view similar to FIG. 15, but showing a seventh embodiment of the present invention.

Referring to FIG. 17, there is shown a decompression brake device which is a seventh embodiment of the present invention.

The device of this embodiment is substantially the same as that of the above-mentioned fifth embodiment of FIG. 15 except that in the seventh embodiment the second stopper member 147 is integrated with the separate cylinder member 134.

Figure 18:
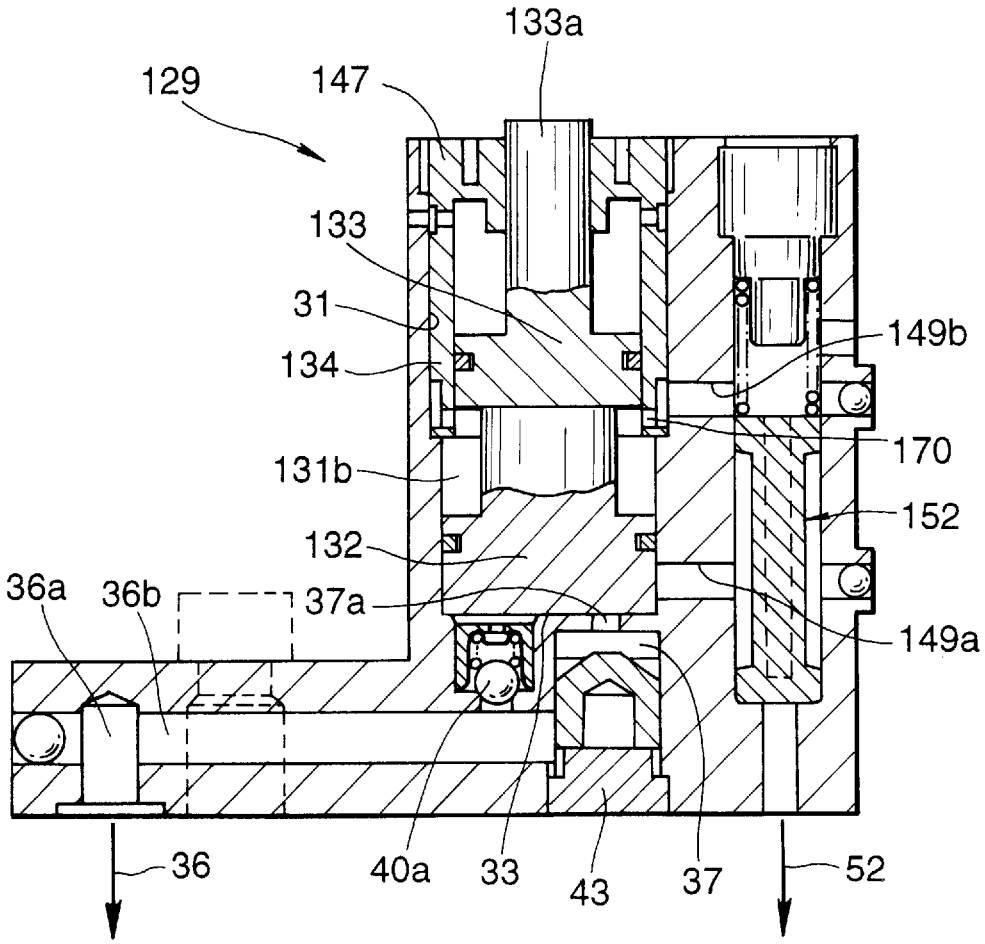
FIG. 18 is a view similar to FIG. 15, but showing an eighth embodiment of the present invention.

Referring to FIG. 18, there is shown a decompression brake device which is an eighth embodiment of the present invention.

The device of this embodiment is substantially the same as that of the above-mentioned seventh embodiment of FIG. 17 except that in the eighth embodiment the stopper ring 48 used in the seventh embodiment is not employed. That is, the cylinder member 134 is tightly fitted in the cylindrical bore 31.

Figure 19:
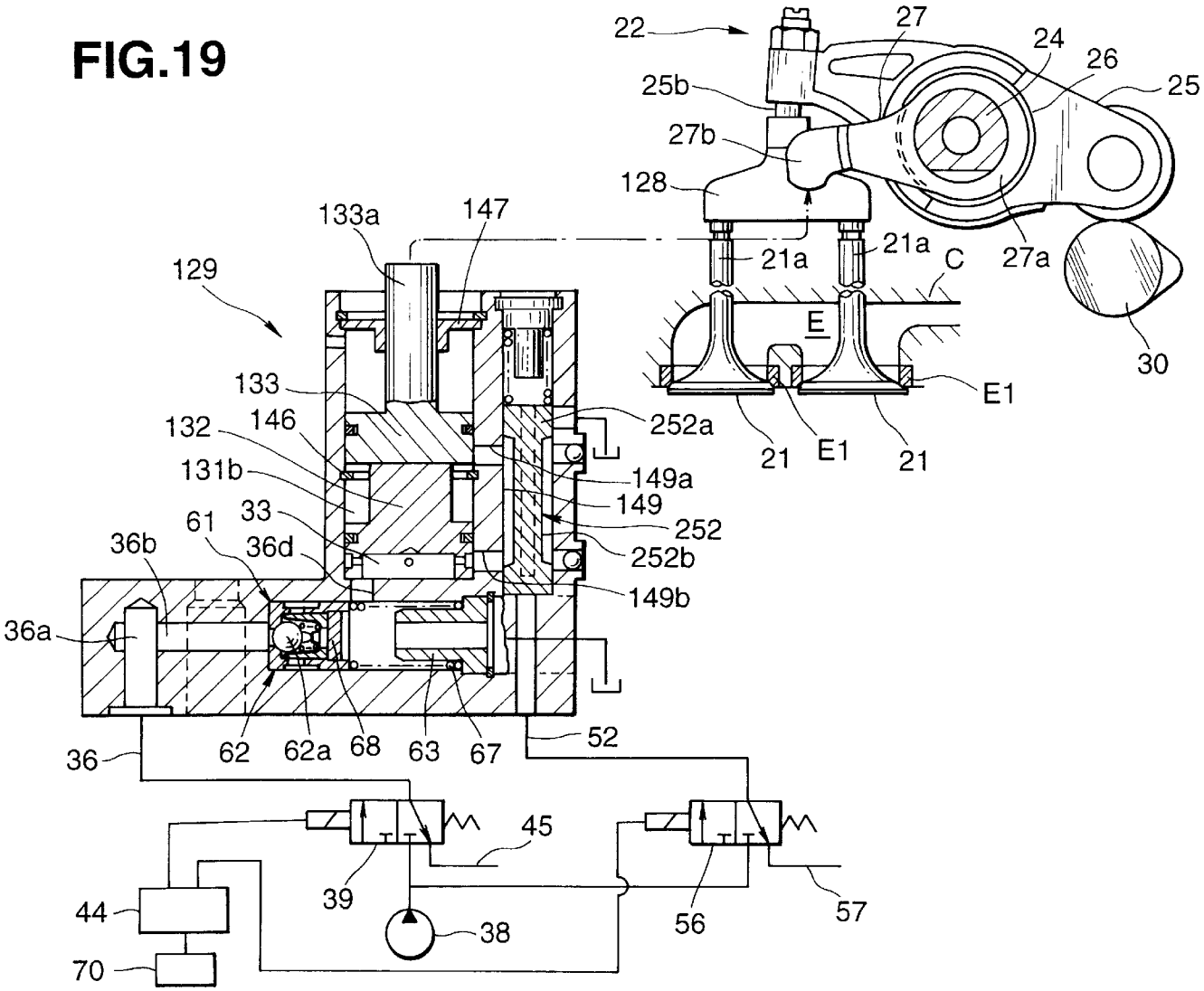
FIG. 19 is a sectional view of a decompression brake device of a ninth embodiment of the present invention, and a part of an internal combustion.

Referring to FIGS. 19 to 22, particularly FIG. 19, there is shown a decompression brake device which is a ninth embodiment of the present invention.

As shown in FIG. 19, the device of this embodiment is applied to an internal combustion engine of a type which employs two exhaust valves 21 for each combustion chamber. The two exhaust valves 21 have respective stems 21*a* held by a holder 128. A head of the holder 28 is pressed by one end 25*b* of a rocker arm 25. The other end of the rocker arm 25 is engaged with a cam 130. The rocker arm 25 is swingably supported by a rocker shaft 24 through a cam ring 26. A lever 27 is fixed at one end 27*a* to one end portion of the rocker shaft 24. The other end 27*b* of the lever 27 has a spherical lower end, as shown.

An actuator 129 for pushing the other end 27*b* of the lever 27 is similar to the actuator 29 employed in the fourth embodiment of FIG. 12. Thus, only portions and parts different from those of the actuator 29 of the fourth embodiment will be described in the following.

Figure 20:
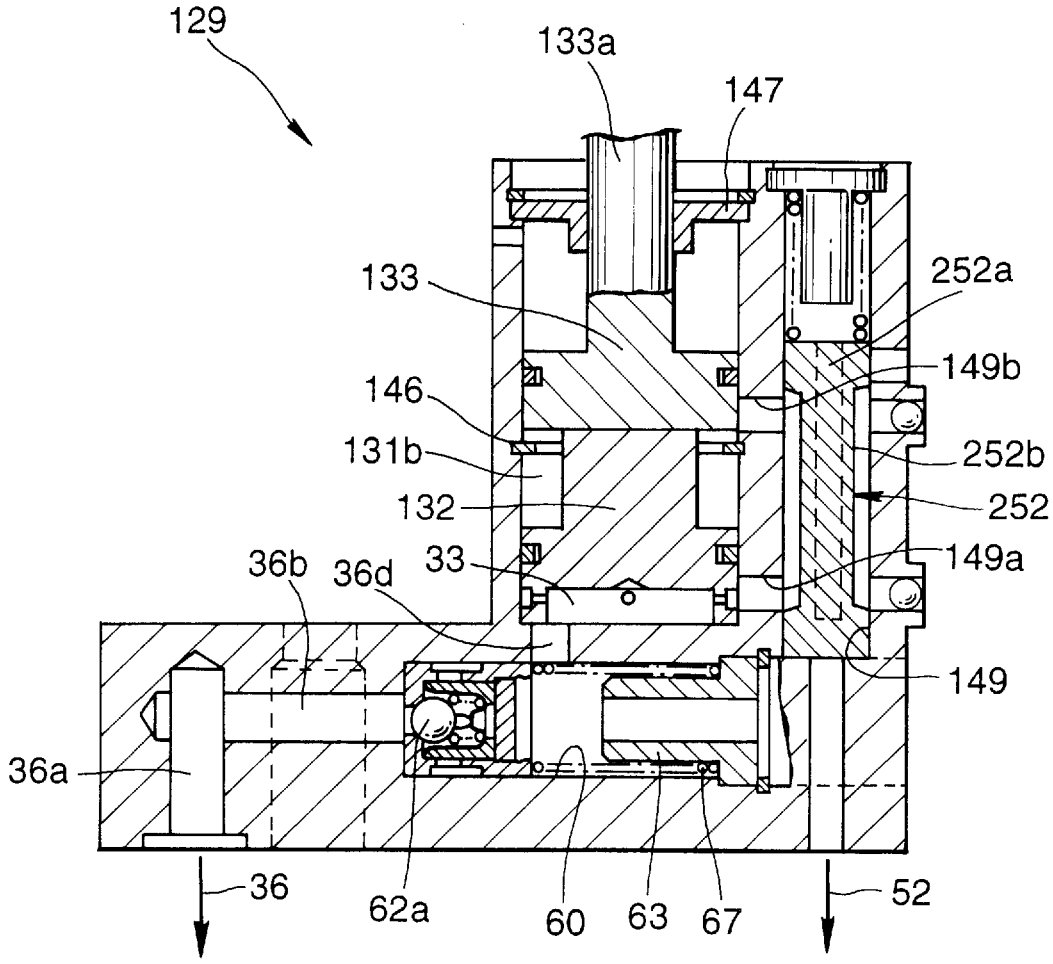
FIGS. 20, 21 and 22 are sectional views of the decompression brake device of the ninth embodiment, but showing different operating conditions.
Figure 21:
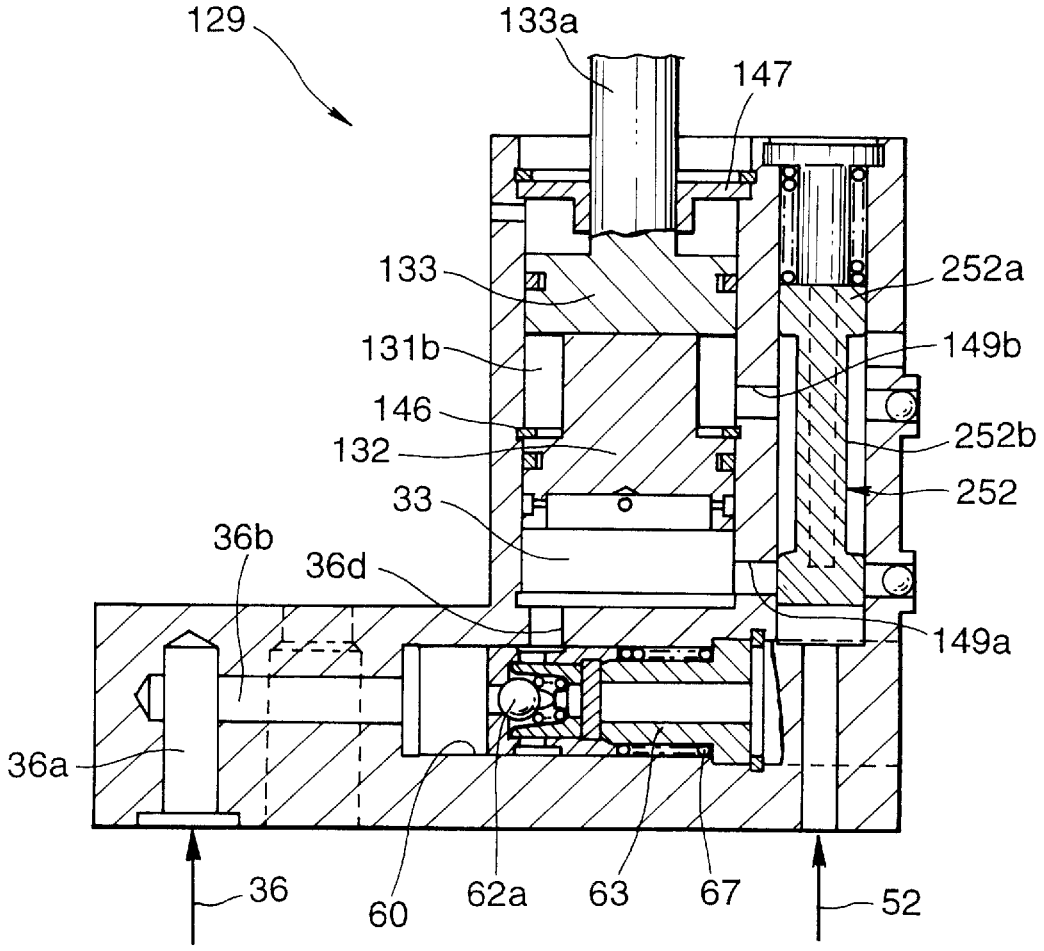
Figure 22:
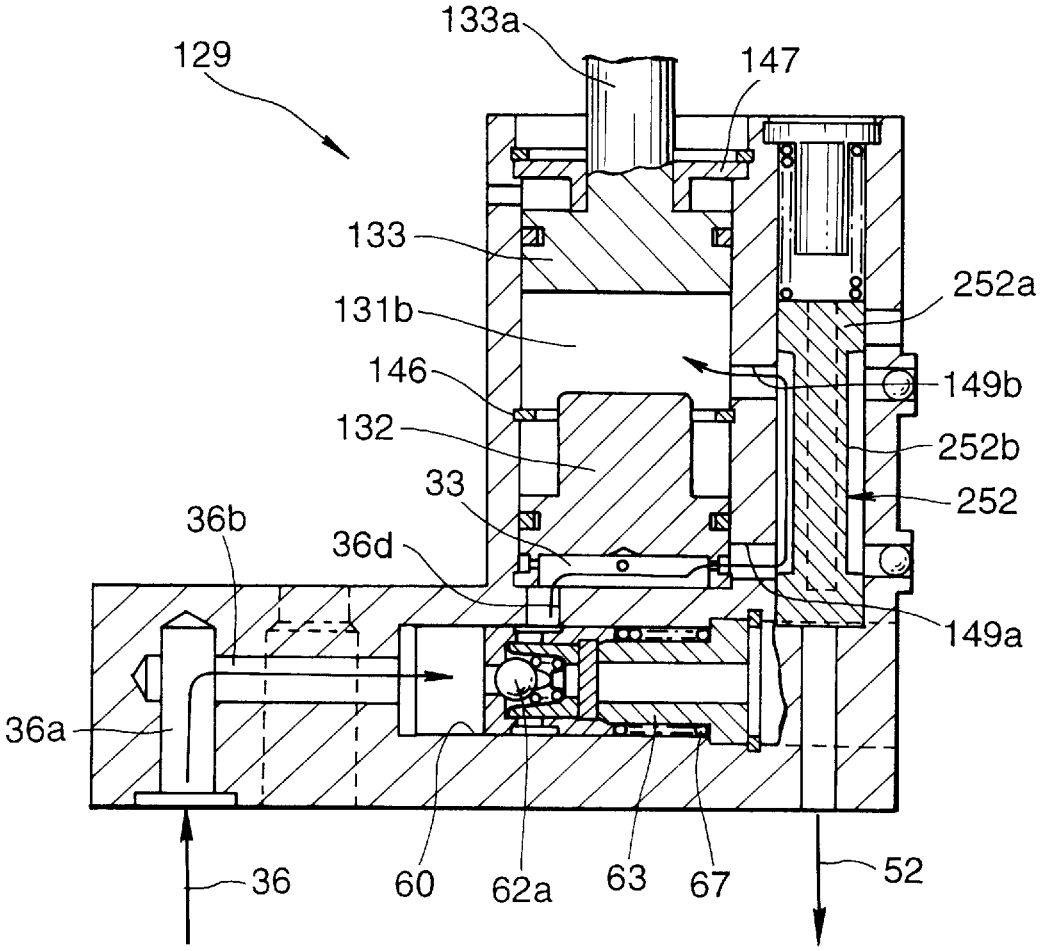

As is seen from FIGS. 19 and 20, in the actuator 129 of the ninth embodiment, a spool valve 252 is different from the spool valve 152 of the fourth embodiment. That is, when the spool 252*a* of the valve 252 takes its lowermost position, the annular groove 252*b* of the spool 252*a* establishes a communication between the first and second hydraulic chambers 33 and 131*b*.

Under normal cruising of an associated motor vehicle, the actuator 129 in this ninth embodiment assumes a condition depicted by FIGS. 19 and 20. That is, in such cruising condition, the controller 44 establishes a drained condition in both the horizontal bore 36*b* and the vertically extending bore 149. Thus, the valve drive mechanism is forced to the first condition and thus engine braking expected by the decompression brake device is not carried out.

When, under a lower engine speed condition, the driver turns the exhaust brake switch ON, the controller 44 controls the first and second electromagnetic valves 39 and 56 in such a manner that both the passages 36 and 52 are communicated with the oil pump 38. With this, as is seen from FIG. 21, the spool 252*a* is moved up to its uppermost position shutting the connection between first and second hydraulic chambers 33 and 131*b*, and at the same time, the first piston 132 is moved up to its uppermost position lifting the second piston 133 to the middle position. Thus, the valve drive mechanism 22 is forced to the second condition, and thus, engine braking suitable for a lower engine speed condition is obtained.

While, when, under a higher engine speed condition, the driver turns the exhaust brake switch ON, the controller 44 controls the first and second electromagnetic valves 39 and 56 in such a manner that the passage 36 is communicated with the oil pump 38 and the passage 52 is communicated with the drain passage 57. With this, the spool 252*a* is moved to the lowermost position establishing the communication between the first and second hydraulic chambers 33 and 131*b*, and at the same time, pressurized oil is led into the second hydraulic chamber 131*b* from the oil pump 38 through the horizontal bore 36*b*, the first hydraulic chamber 33 and the annular groove 252*b* of the spool 252*a*, pushing the second piston 133 to its uppermost position. Thus, the valve drive mechanism 22 is forced to assume the third condition, and thus engine braking suitable for a higher engine speed is obtained.

In this ninth embodiment, a fail-safe function is expected in a failure of operation of the device. That is, when both the valves 39 and 56 fail to operate, the second piston 133 the lowermost position, which causes the valve drive mechanism 22 to take the first condition. When only the valve 39 fails to operate, feeding a pressurized oil to the passage 52 from the valve 56 brings about only upward movement of the spool 252*a*, having no effect on the second piston 133 assuming the lowermost position.

Figure 23:
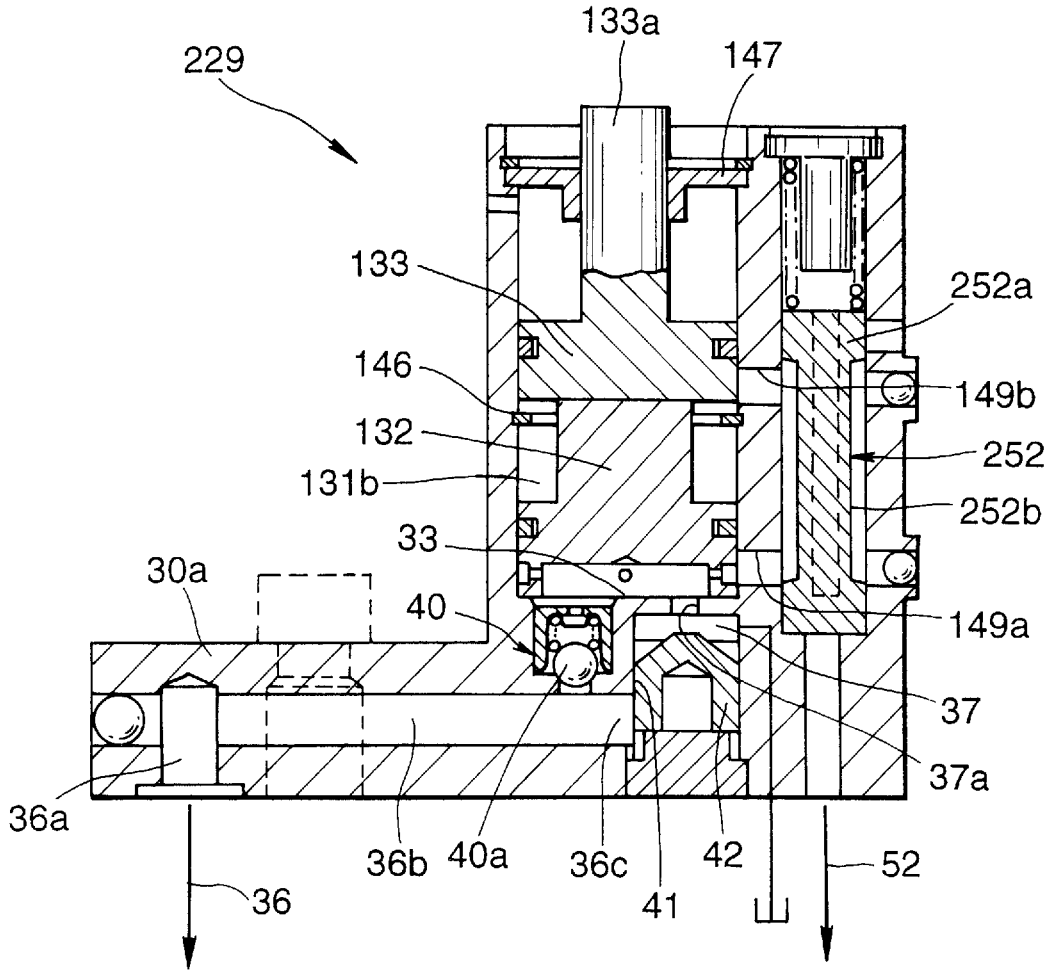
FIG. 23 is a sectional view of a decompression brake device of a tenth embodiment of the present invention.
Figure 24:
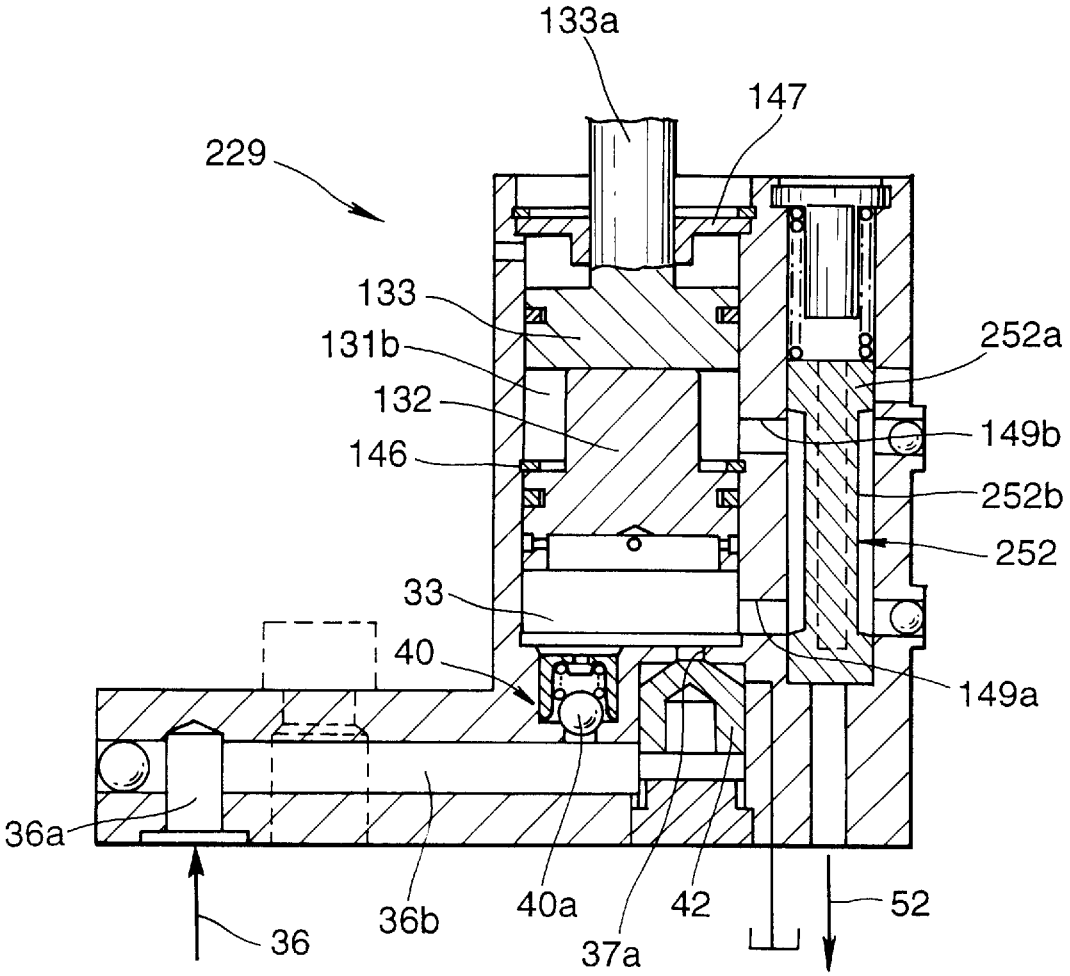
FIGS. 24 and 25 are views similar to FIG. 23, but showing different operating conditions of the tenth embodiment.
Figure 25:
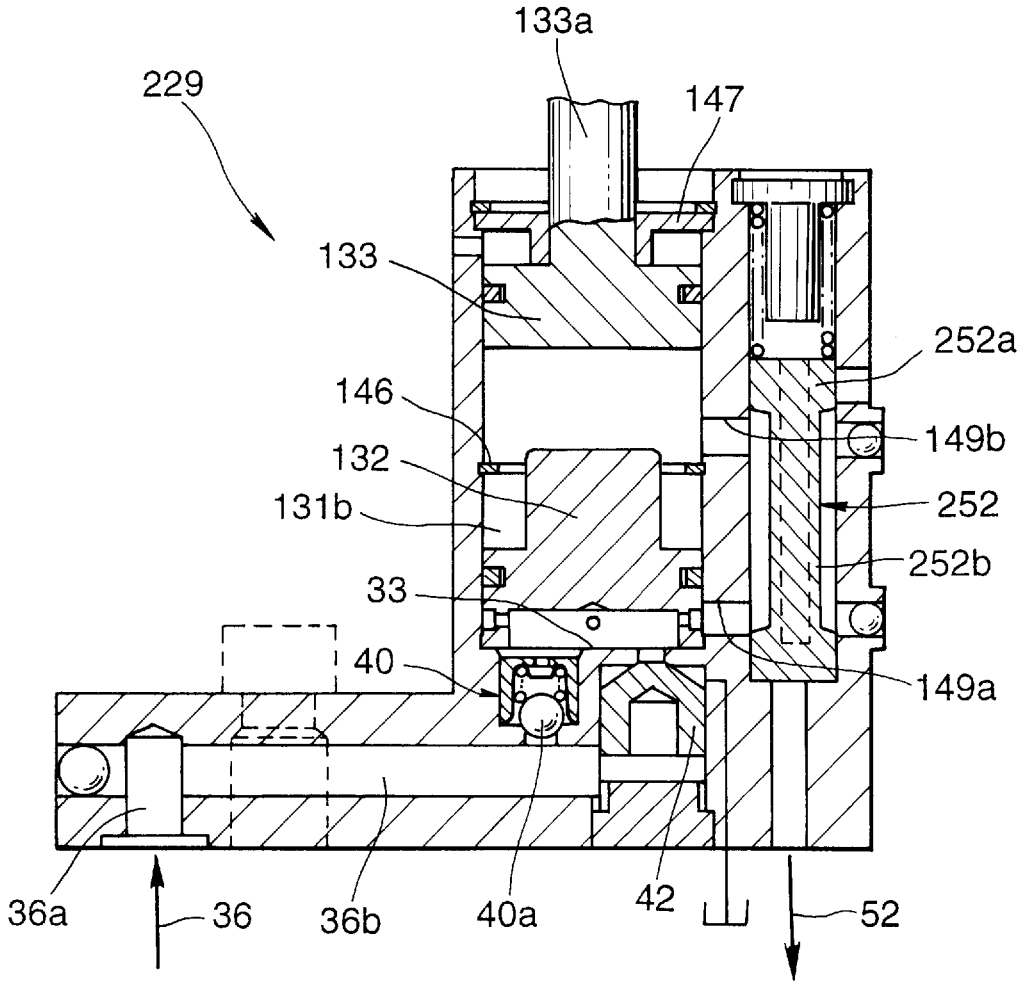

Referring to FIGS. 23 to 25, particularly FIG. 23, there is shown an actuator 229 which is employed in a decompression brake device of a tenth embodiment.

Since the actuator 229 is similar to the actuator 29 employed in the above-mentioned third embodiment of FIG. 8, only portions and parts different from those of the actuator 29 of the third embodiment will be described in the following.

As is seen from FIG. 23, in the actuator 229 of the tenth embodiment, a spool valve 252 is different from the spool valve 152 of the third embodiment. That is, when the spool 252*a* of the valve 252 takes its lowermost position, the annular groove 252*b* of the spool 252*a* establishes a communication between the first and second hydraulic chambers 33 and 131*b*, like in the case of the above-mentioned ninth embodiment.

Operation of the decompression brake device of the tenth embodiment is substantially the same as that of the ninth embodiment. That is, FIG. 23 shows a condition wherein the second piston 133 assumes the lowermost position causing the valve drive mechanism 22 to take the first condition, FIG. 24 shows a condition wherein the second piston 133 assumes the middle position causing the valve drive mechanism 22 to take the second condition, and FIG. 25 shows a condition wherein the second piston 133 assumes the uppermost position causing the valve drive mechanism 22 to take the third condition.

Figure 26:
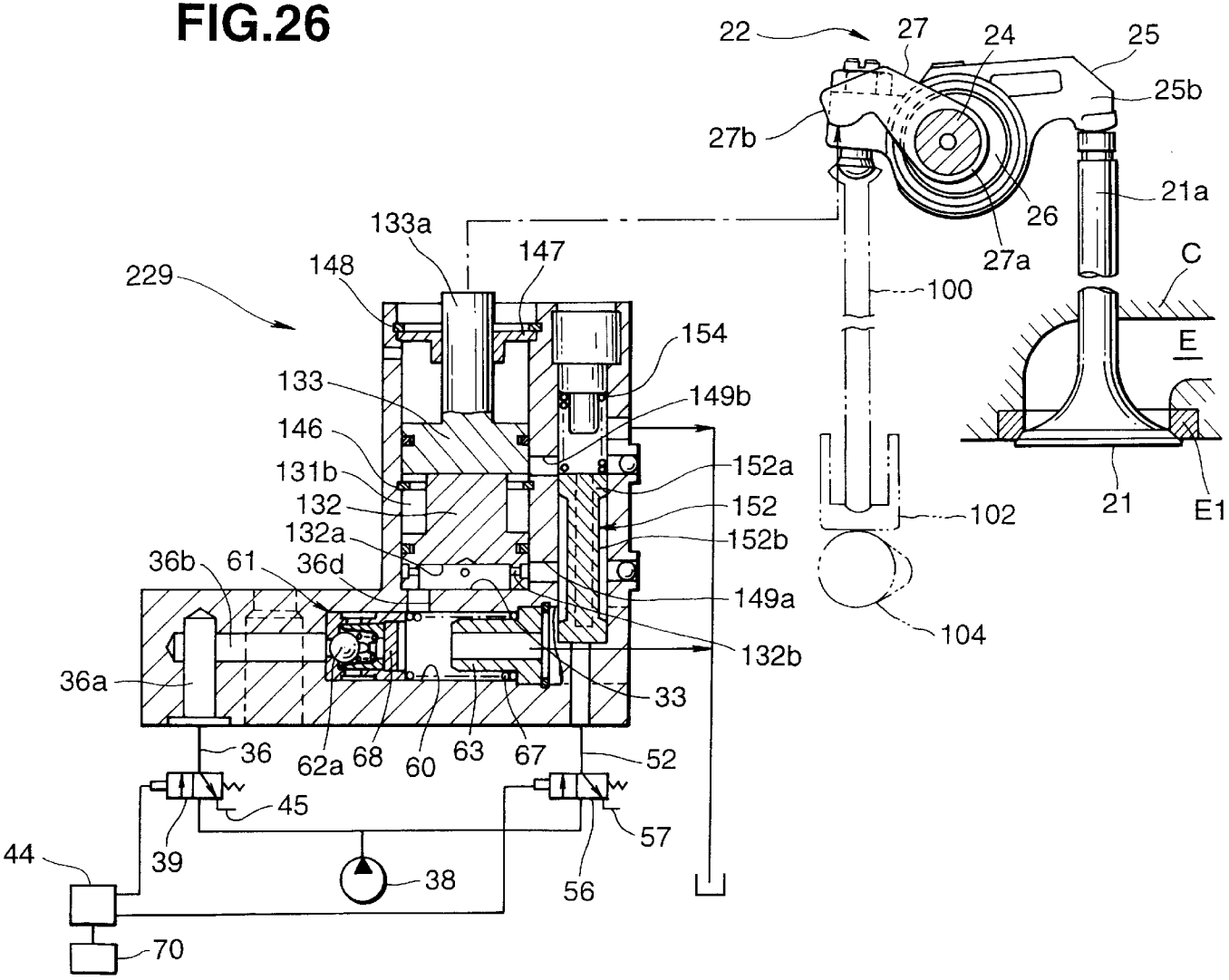
FIG. 26 is a sectional view of a decompression brake device of an eleventh embodiment of the present invention, and a part of an internal combustion engine.
Figure 27:
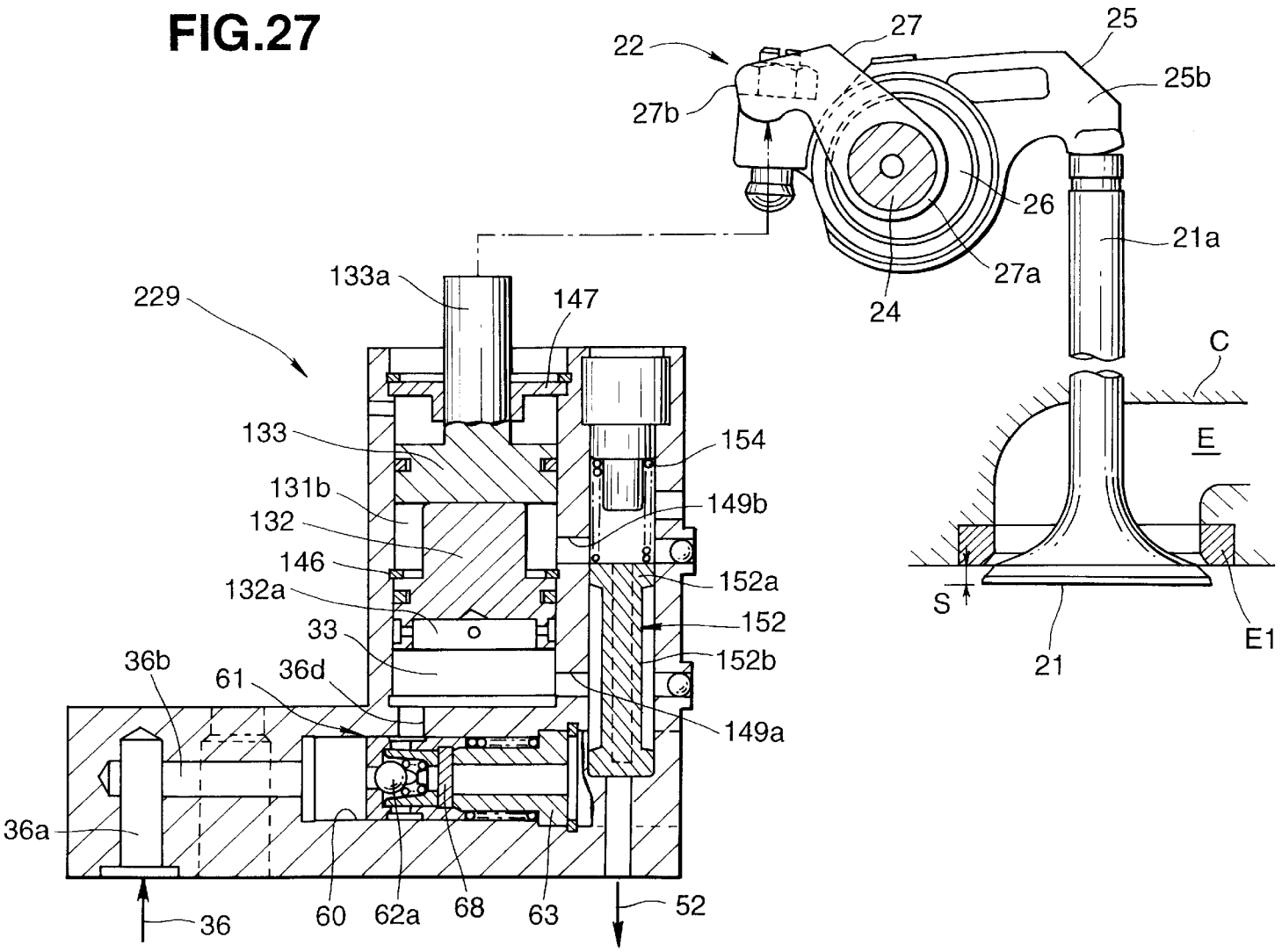
FIGS. 27 and 28 are views similar to FIG. 26, but showing different operating conditions of the eleventh embodiment.
Figure 28:
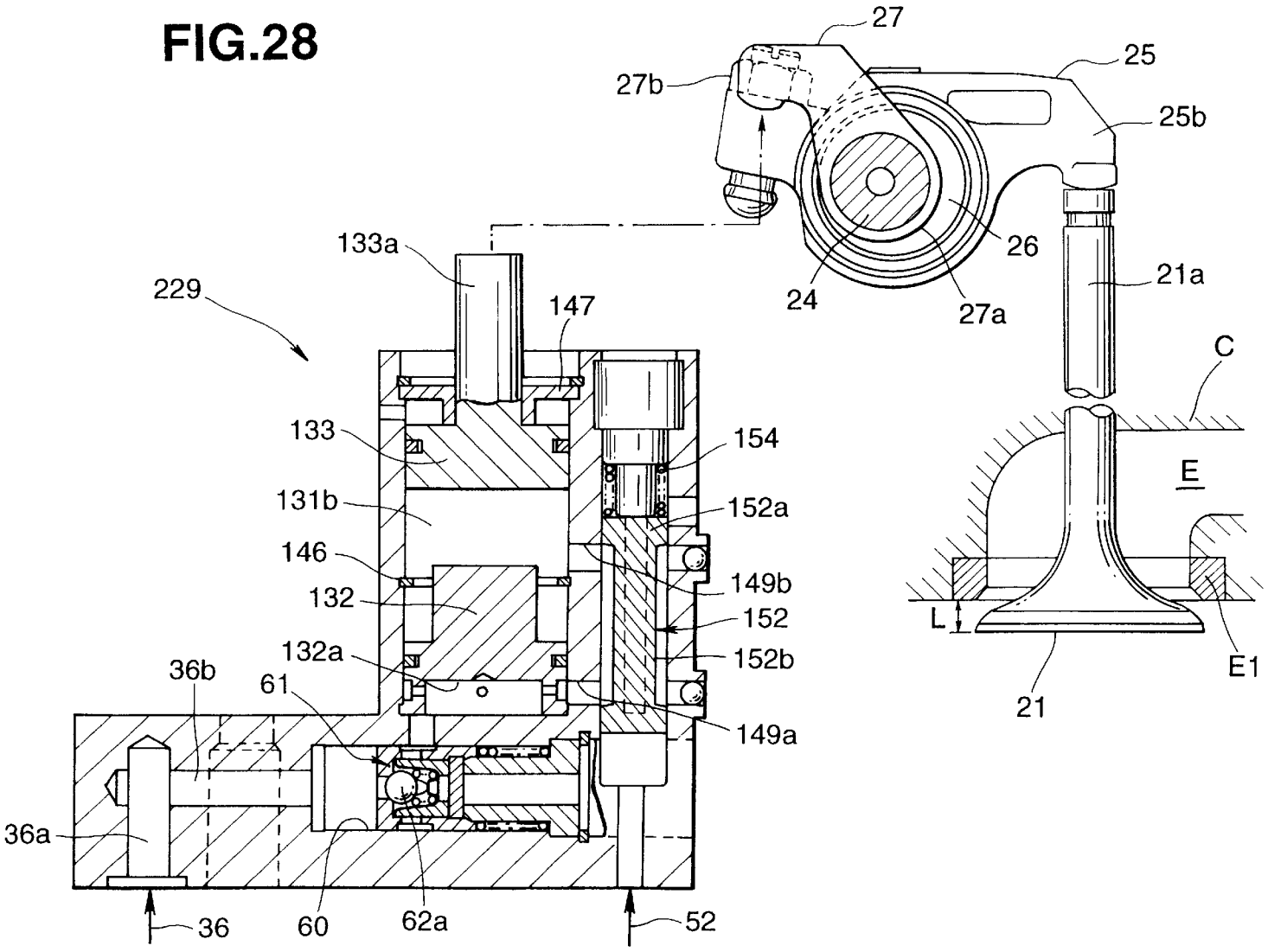

Referring to FIGS. 26 to 28, particularly FIG. 26, there is shown a decompression brake device which is an eleventh embodiment of the present invention. In FIG. 26, a push rod 100, a valve lifter 102 and a cam 104 are shown, which are arranged to pivot the rocker arm 25 in accordance with operation of the engine.

Since the decompression brake device of this eleventh embodiment is similar to that of the above-mentioned fourth embodiment of FIG. 12, only portions and parts different from those of the fourth embodiment will be described in the following. Substantially same portions and parts are denoted by the same numerals as in the fourth embodiment.

As is seen from FIG. 26, the first piston 132 is formed at a lower end thereof with a recess 132*a* which is bounded by an annular lower wall. The recess 132*a* is merged with the first hydraulic chamber 33. The annular lower wall has an opening 132*b* connected with the recess 132*a*.

It is to be noted that when the first piston 132 assumes its lowermost position, the recess 132*a* is communicated with the first opening 149*a* through the opening 132*b*.

Operation of the decompression brake device of this eleventh embodiment is substantially the same as that of the fourth embodiment of FIG. 12. That is, FIG. 26 shows a condition wherein the second piston 133 assumes the lowermost position causing the valve drive mechanism to take the first condition, FIG. 27 shows a condition wherein the second piston 133 assumes the middle position causing the valve drive mechanism 22 to take the second condition, and FIG. 28 shows a condition wherein the second piston 133 assumes the uppermost position causing the valve drive mechanism 22 to take the third condition.

It is to be noted that actually the device of this eleventh embodiment is superior to that of the fourth embodiment in the following respect.

That is, as is seen from FIG. 28, even when the first piston 132 is forced to assume its lowermost position for some reason upon application of pressurized oil to the first hydraulic chamber 33, communication between the first hydraulic chamber 33 and the first opening 149*a* is assuredly established. Thus, the second piston 133 can be moved up to its uppermost position due to feeding of the pressurized oil to the second hydraulic chamber 131*b* through the annular groove 152*b* of the spool 152*a*. While, in case of the fourth embodiment (see FIG. 14), placing the first piston 132 at the lowermost position shuts the communication between the first hydraulic chamber 33 with the first opening 149*a*. Of course, in this case, pressurized oil is not supplied to the second hydraulic chamber 131*b*.

Figure 29:
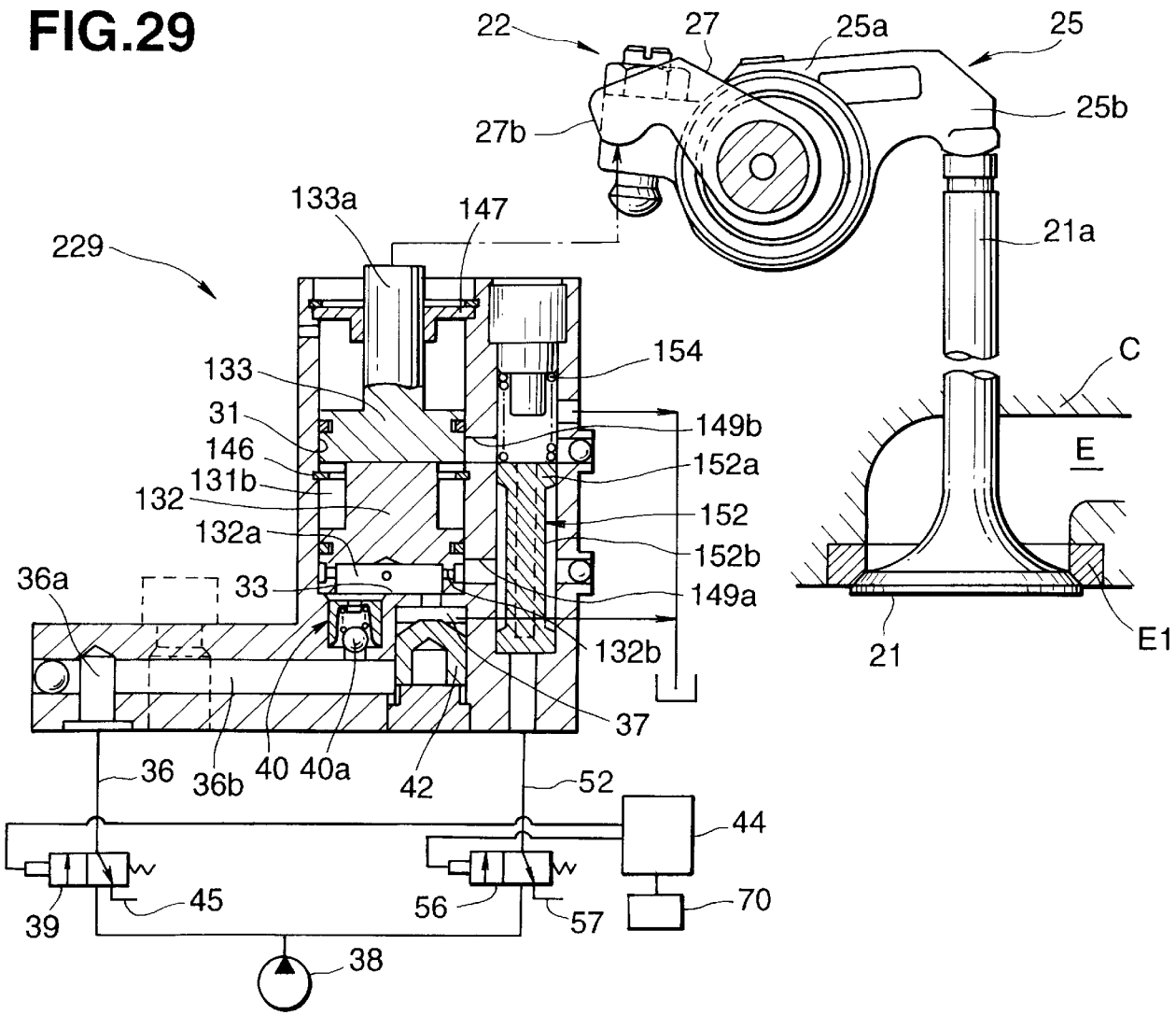
FIG. 29 is a sectional view of a decompression brake device of a twelfth embodiment of the present invention, and a part of an internal combustion engine.
Figure 30:
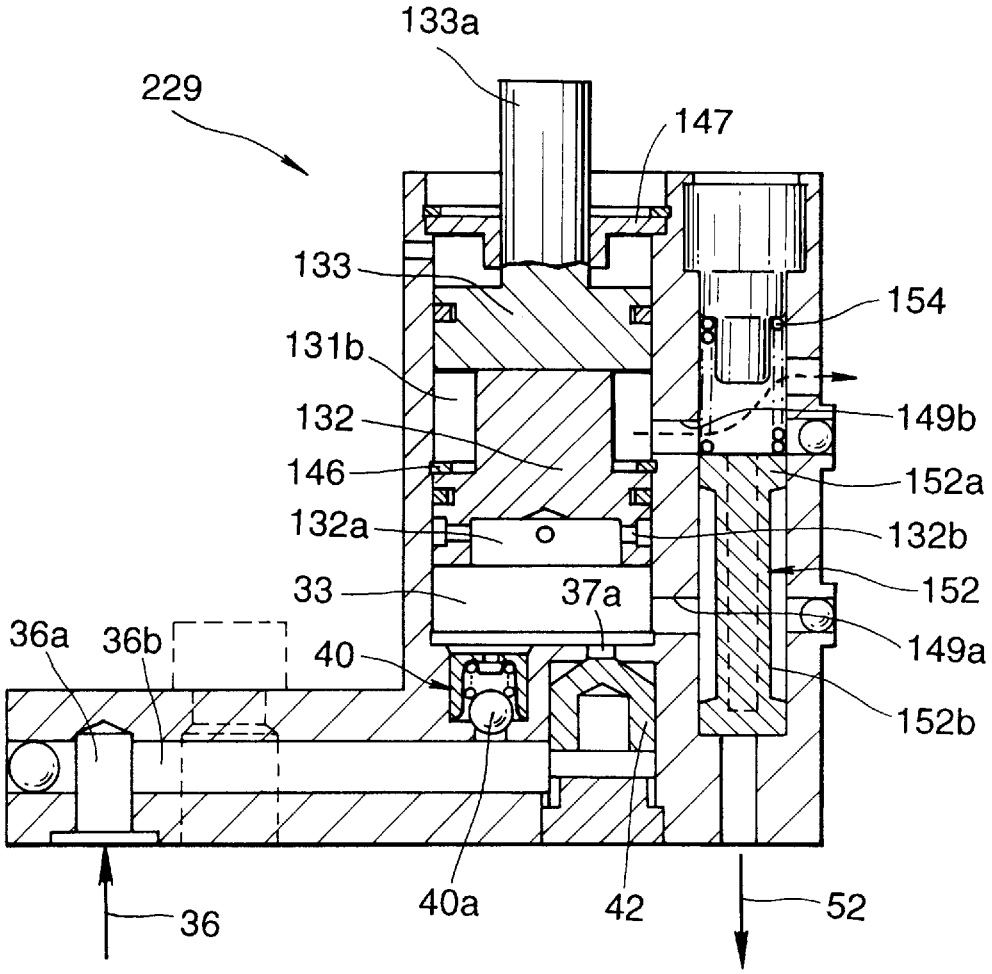
FIGS. 30 and 31 are views similar to FIG. 29, but showing different operating conditions of the twelfth embodiment.
Figure 31:
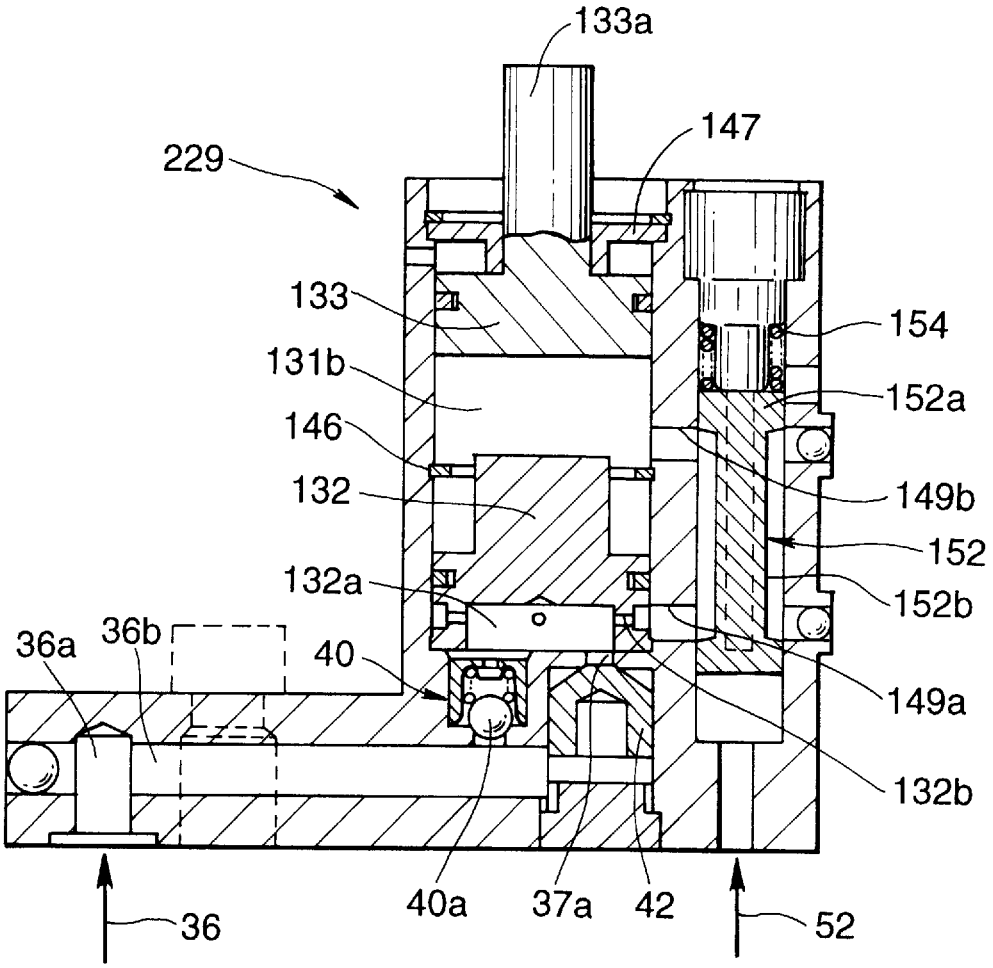
Figure 32:
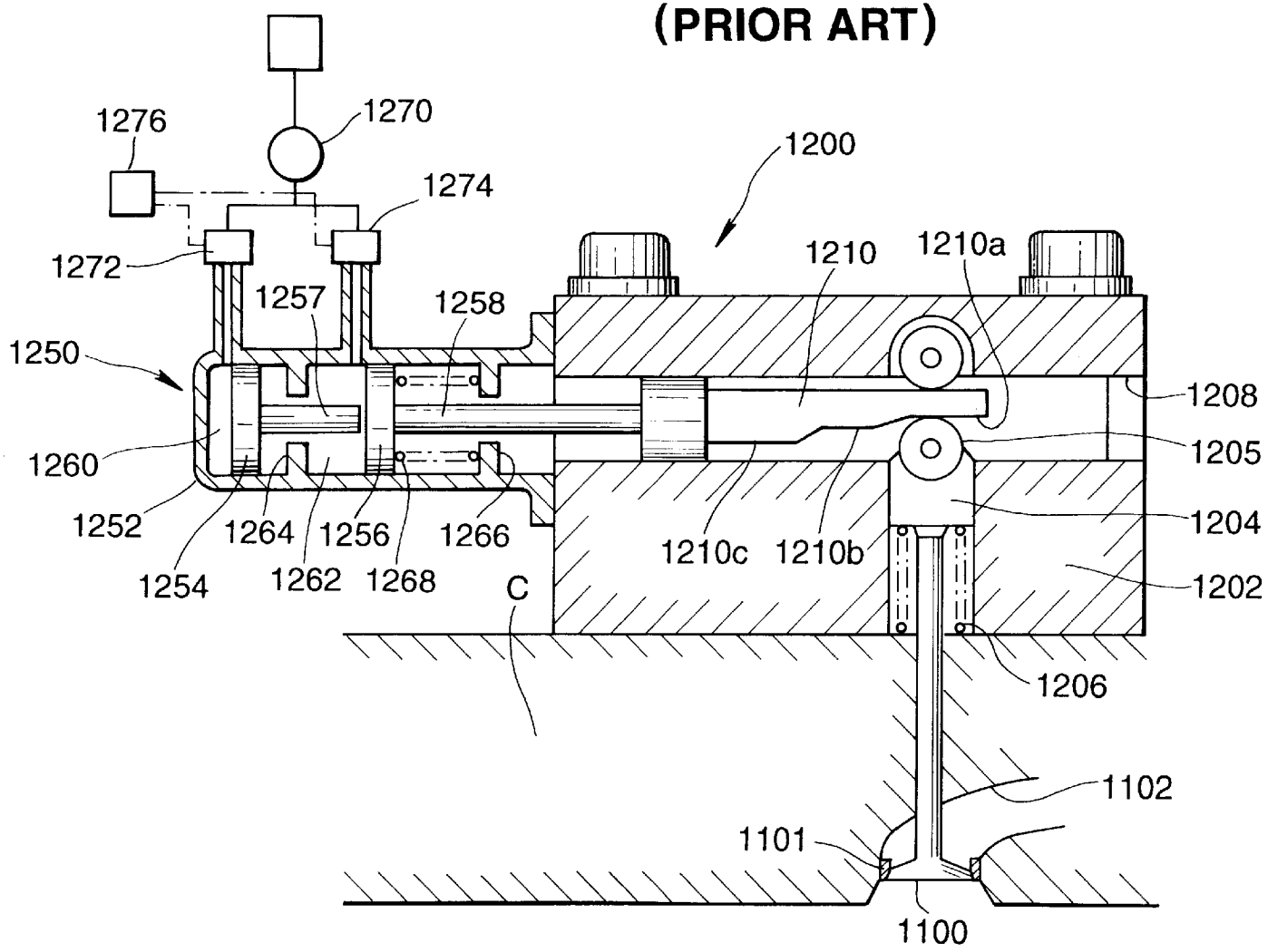
FIG.32 (PRIOR ART)
FIG. 32 is a sectional view of a conventional decompression brake device disclosed in Japanese Utility Model First Provisional Publication 4-54907.

Referring to FIGS. 29 to 31, particularly FIG. 29, there is shown a decompression brake device which is a twelfth embodiment of the present invention.

Since the decompression brake device of this twelfth embodiment is similar to that of the above-mentioned third embodiment of FIG. 8, only portions and parts different from those of the fifth embodiment will be described in the following. Substantially same portions and parts are denoted by the same numerals as in the third embodiment.

As is seen from FIG. 29, the first piston 132 is formed at a lower end thereof with a recess 132*a* which is bounded by an annular lower wall. The recess 132*a* is merged with the first hydraulic chamber 33. The annular lower wall has an opening 132*b* connected with the recess 132*a*.

It is to be noted that when the first piston 132 assumes its lowermost position, the recess 132*a* is communicated with the first opening 149*a* through the opening 132*b*.

Operation of the decompression brake device of this twelfth embodiment is substantially the same as that of the third embodiment of FIG. 8. That is, FIG. 29 shows a condition wherein the second piston 133 assumes the lowermost position causing the valve drive mechanism 22 to take the first condition, FIG. 30 shows a condition wherein the second piston 133 assumes the middle position causing the valve drive mechanism 22 to take the second condition, and FIG. 31 shows a condition wherein the second piston 133 assumes the uppermost position causing the valve drive mechanism 22 to take the third condition.

It is to be noted that actually, the device of this twelfth embodiment is superior to that of the third embodiment in the same respect as is described in the eleventh embodiment. That is, when the first piston 132 is forced to assume its lowermost position (see FIG. 31) for some reason upon application of pressurized oil to the first hydraulic chamber 33, communication between the first hydraulic chamber 33 and the first opening 149*a* is assuredly established.

In the following, advantages of the present invention will be described.

First, by controlling an ordinary exhaust valve 21, three engine braking modes are assuredly obtained in accordance with the engine speed, which are an ordinary engine braking mode wherein the exhaust valve 21 assumes its fully closed rest position during intake, compression and expansion strokes of the corresponding cylinder and a full open position during an exhaust stroke of the cylinder, a first engine braking mode wherein the exhaust valve 21 assumes the fully closed rest position during the intake stroke of the cylinder, a slightly open rest position during the compression and expansion strokes of the cylinder and the fully open position during the exhaust stroke of the cylinder and a second engine braking mode wherein the exhaust valve 21 assumes the fully closed rest position during the intake stroke of the cylinder, a largely open rest position during the compression and expansion strokes of the cylinder and the full open position during the exhaust stroke of the cylinder.

Second, the actuator 29, 129 or 229 of the decompression brake device is compact in size. That is, as is understood from the drawings, for example, from FIG. 1, the parts of the actuator 29 are compactly assembled in both the horizontal and vertical portions 30*a* and 30*b* of the body 30. This brings about a compact construction of the entire of the decompression brake device.

Third, because the two electromagnetic valves 39 and 56 are of a type which establishes a drained condition of the associated passage 36 or 56 when deenergized, a fail-safe function is possessed by the decompression brake device. That is, when the controller 44 fails to energize the valves 39 and 52, the drained condition is established and thus the valve drive mechanism 22 is forced to take the first condition. Under this condition, ordinary engine braking can be obtained.

What is claimed is:

1. A decompression brake device for use with an internal combustion engine having an exhaust valve, comprising:

a valve drive mechanism for driving said exhaust valve, said valve drive mechanism having first, second and third conditions, said first condition being a condition wherein said exhaust valve assumes a fully closed rest position during intake, compression and expansion strokes of a corresponding engine cylinder and a full open position during an exhaust stroke of the engine cylinder, said second condition being a condition wherein said exhaust valve assumes the fully closed rest position during the intake stroke of the engine cylinder, a slightly open rest position during the compression and expansion strokes of the engine cylinder and the full open position during the exhaust stroke of the engine cylinder, and said third condition being a condition wherein said exhaust valve assumes the fully closed rest position during the intake stroke of the engine cylinder, a largely open rest position during the compression and expansion strokes of the engine cylinder and the full open position during the exhaust stroke of the engine cylinder;

an actuator having a hydraulically actuated rod which has first, second and third positions to cause said valve drive mechanism to assume said first, second and third conditions respectively; and a hydraulic circuit for feeding or drawing a pressurized oil to or from said actuator to move said rod to one of said first, second and third positions.

2. A decompression brake device as claimed in claim 1, in which said actuator comprising:

a body having a piston chamber formed therein;

a piston structure operatively received in said piston chamber, said piston structure having a part which moves with said rod;

first and second hydraulic passages defined in said body, each of said first and second hydraulic passages being arranged between said hydraulic circuit and said piston chamber, and first and second valve means respectively installed in said first and second hydraulic passages for controlling movement of said piston structure in accordance with a hydraulic pressure existing in said first and second hydraulic passages.

3. A decompression brake device as claimed in claim 2, in which said piston structure is a single piston which has said rod integrally connected thereto, and in which said first valve means permits said single piston to move to second and third positions corresponding to the second and third positions of said rod when opened, and in which said second valve means suppresses said single piston from moving from the second position to the third position when the pressurized oil is drained from said second hydraulic passage.

4. A decompression brake device as claimed in claim 3, in which said second valve means comprises a plunger which is moved to a position to suppress said movement of said single piston when the pressurized oil is drained from the second hydraulic passage.

5. A decompression brake device as claimed in claim 4, in which said plunger is formed with a stopper pin which protects into the piston chamber to stop said movement of said single piston when the pressurized oil is drained from second hydraulic passage.

6. A decompression brake device as claimed in claim 5, in which said plunger is biased by a spring in a direction to project the stopper pin into the piston chamber.

7. A decompression brake device as claimed in claim 4, in which said first valve means comprises:

a check valve which permits only a flow of the pressurized oil from said first hydraulic passage into a working chamber of said piston chamber; and a free piston which shuts a connection between the working chamber and a drain passage when the first hydraulic passage is fed with the pressurized oil.

8. A decompression brake device as claimed in claim 7, in which said free piston has a conical head which shuts a reduced part of said drain passage when the free piston is moved toward said reduced part upon application of the pressurized oil into said first hydraulic passage.

9. A decompression brake device as claimed in claim 4, in which said first valve means comprises:

means defining in said first hydraulic passage an enlarged bore portion;

means defining an opening through which the enlarged bore portion and said working chamber are connected;

a spool slidably received in said enlarged bore portion, said spool establishing a connection between said first hydraulic passage and said working chamber when assuming a given position;

biasing means for biasing said spool toward an upstream portion of said first hydraulic passage; and a check valve installed in said spool, said check valve permitting only a flow of the pressurized oil from said first hydraulic passage into said working chamber.

10. A decompression brake device as claimed in claim 2, in which said piston structure comprises:

a first piston slidably received in a lower portion of said piston chamber, said first piston being movable between its lowermost position to its uppermost position;

a second piston slidably received in an upper portion of said piston chamber, said second piston having said rod integrally connected thereto, said second piston having its lowermost position wherein an upper end of said first piston assuming its lowermost position contacts a bottom of said second piston, its middle position wherein the upper end of said first piston assuming its uppermost position contacts the bottom of said second piston and its uppermost position wherein the bottom of said second piston separated from the upper end of said first piston assuming its uppermost position, wherein a first working chamber is defined in said piston chamber below said first piston and a second working chamber is defined in said piston chamber between said first and second pistons.

11. A decompression brake device as claimed in claim 10, in which said first valve means permits said first piston to move from its lowermost position to its uppermost position when opened to feed the pressurized oil into said first working chamber and in which said second valve means suppresses feeding of the pressurized oil to said second working chamber thereby suppressing said second piston to assume its uppermost position when the pressurized oil is drained form said second hydraulic passage.

12. A decompression brake device as claimed in claim 11, in which said second valve means comprises:

a vertically extending bore defined in said body, a lower part of said bore being connected with said second hydraulic passage;

a first opening for connecting said first working chamber with said vertically extending bore;

a second opening for connecting said second working chamber with said vertically extending bore;

a spool slidably received in said vertically extending bore, said spool blocking a communication between said first and second openings through said vertically extending bore when the pressurized oil is drained from said second hydraulic passage and establishing said communication when the pressurized oil is fed into the second hydraulic passage.

13. A decompression brake device as claimed in claim 12, in which said spool is biased by a spring in a direction to block said communication.

14. A decompression brake device as claimed in claim 11, in which said first valve means comprises:

a check valve which permits only a flow of the pressurized oil from said first hydraulic passage into said first working chamber; and a free piston which shuts a connection between said first working chamber and a drain passage when said first hydraulic passage is fed with the pressurized oil.

15. A decompression brake device as claimed in claim 11, in which said first valve means comprises:

means defining in said first hydraulic passage an enlarged bore portion;

means defining an opening through which the enlarged bore portion and said first working chamber are connected;

a spool slidably received in said enlarged bore portion, said spool establishing a connection between said first hydraulic passage and said first working chamber when assuming a given position;

biasing means for biasing said spool toward an upstream portion of said first hydraulic passage; and a check valve installed in said spool, said check valve permitting only a flow of the pressurized oil from said first hydraulic passage into said first working chamber.

16. A decompression brake device as claimed in claim 10, further comprising a separate cylinder member which is coaxially and tightly received in the upper portion of said piston chamber to slidably receive therein said second piston.

17. A decompression brake device as claimed in claim 16, in which a lower end of said separate cylinder chamber projects into said second working chamber to serve as a stopper for restricting the uppermost position of said first piston.

18. A decompression brake device as claimed in claim 17, in which said separate cylinder chamber has an integral upper lid portion which serves as a stopper for restricting the uppermost position of said second piston.

19. A decompression brake device as claimed in claim 10, in which first valve means permits said first piston to move from its lowermost position to its uppermost position when opened to feed the pressurized oil into said first working chamber and in which said second valve means suppresses feeding of the pressurized oil to said second working chamber thereby suppressing said second piston to assume its uppermost position when the pressurized oil is fed to said second hydraulic passage.

20. A decompression brake device as claimed in claim 19, in which said second valve means comprises:

a vertically extending bore defined in said body, a lower part of said bore being connected with said second hydraulic passage;

a first opening for connecting said first working chamber with said vertically extending bore;

a second opening for connecting said second working chamber with said vertically extending bore;

a spool slidably received in said vertically extending bore, said spool blocking a communication between said first and second openings through said vertically extending bore when the pressurized oil is fed to said second hydraulic passage and establishing said communication when the pressurized oil is drained from said second hydraulic passage.

21. A decompression brake device as claimed in claim 19, in which said first piston is formed at a lower end thereof with a recess which is bounded by an annular lower wall, said recess being merged with said first working chamber and said annular lower wall being formed with an opening which establishes a communication between said recess and said first opening when said first piston assumes its lowermost position.

22. A decompression brake device as claimed in claim 1, further comprising:

an engine speed sensor for sensing the speed of the engine; and a controller for controlling said hydraulic circuit in accordance with the sensed engine speed, in such a manner that when the engine speed is relatively low, said hydraulic circuit controls the rod of the actuator to have said second position and when the engine speed is relatively high, said hydraulic circuit controls the rod to have said third position.

* * * * *